United States Patent [19]

Messerly et al.

[11] Patent Number: 5,039,084

[45] Date of Patent: Aug. 13, 1991

[54] ARRANGEMENT FOR STACKING BLANKS

[75] Inventors: Robert H. Messerly, Warren; William Semenik, Chardon; Norman H. Fobes, Cortland; Robert J. Prox, Warren, all of Ohio

[73] Assignee: Wean Incorporated, Pittsburgh, Pa.

[21] Appl. No.: 315,933

[22] Filed: Feb. 24, 1989

Related U.S. Application Data

[62] Division of Ser. No. 838,277, Mar. 10, 1986, Pat. No. 4,820,102.

[51] Int. Cl.[5] ..... B65H 31/00

[52] U.S. Cl. ..... 271/213; 187/17; 271/217; 414/786; 414/790; 414/924

[58] Field of Search ..... 271/193; 213/217, 223; 414/788.9, 789.1, 790, 924, 786, 790.8, 793.8; 83/94, 155; 198/679; 187/17

[56] References Cited

U.S. PATENT DOCUMENTS

| | | | |
|---|---|---|---|
| 3,256,010 | 6/1966 | Buccicone | 271/223 X |
| 4,242,024 | 12/1980 | Buta et al. | 271/217 X |
| 4,299,149 | 11/1981 | Haenni et al. | 83/94 X |
| 4,704,060 | 11/1987 | Winski et al. | 414/793.8 X |
| 4,768,913 | 9/1988 | Baba | 414/797 X |

FOREIGN PATENT DOCUMENTS

| | | | |
|---|---|---|---|
| 1907163 | 8/1970 | Fed. Rep. of Germany | 198/679 |
| 3604225 | 8/1987 | Fed. Rep. of Germany | 271/193 |
| 2064405 | 6/1981 | United Kingdom | 83/155 |

*Primary Examiner*—Robert J. Spar
*Assistant Examiner*—Janice Krizek
*Attorney, Agent, or Firm*—Suzanne Kikel; Arnold B. Silverman

[57] ABSTRACT

An arrangement in a press feed line for picking up and conveying metal blanks at generally the same rate of speed they exit speed from the press, and automatically stacking them on a stacker car, or the like. The stacker car has a rotatable base supporting a pallet, which in turn supports the stacked blanks, and is designed for side-shifting and raising and lowering of the base, in the stacking station, thereby allowing the desired positioning of the stacked blanks on the pallet and the pallet on the base. Automated adjustable devices which may conform to the configuration of the blank neatly stack the blanks and variations to the arrangement allow more than one blank to be removed from different sources in the press, thereby permitting more than one stack to be made simultaneously.

9 Claims, 22 Drawing Sheets

ARRANGEMENT FOR STACKING BLANKS

This is a division of application Ser. No. 838,277, filed Mar. 10, 1986, now U.S. Pat. No. 4,820,102.

BACKGROUND AND SUMMARY OF THE INVENTION

This invention relates to conveying blanks or articles having magnetic properties exiting from a press or a shear, and automatically and neatly piling them in a stacking station. It is particularly suited for use with either flat blanks or stamped blanks with a regular or irregular shape.

It will be appreciated that the invention has a wide general use to handling various kinds and shapes of articles such as body parts having magnetic properties and used in the automotive industry; however for purposes herein, it will be discussed as generally applied to handling metal blanks which may be shaped by stamping for such industry, which stamping is done by a press.

Press feed line arrangements for stacking metal parts have been developed heretofore. These arrangements include a catching conveyor disposed immediately adjacent to the exit of the press and an overhead magnetic conveyor for receiving the blanks from the line and dropping the same in a piling or stacking station, where they come to rest in stacked relation on a pallet supported by a stacker car from whence the stack with the pallet is readily removed and sent downstream along the feed line for further processing operations or storage. Some of the background for the present invention can be found in U.S. Pat. Nos. 2,374,174; 3,020,810; and 3,369,806 issuing to Buccione.

While such arrangements for slow speed operation and for heavy gauge, flat regular shaped stock have proven to a degree to be successful, they have been found to be unacceptable for present-day more stringent requirements where the speeds are substantially higher, the gauges are substantially thicker, and the blanks take many different sizes, contours, and shapes, and their tolerances for surface scratching has been substantially decreased.

In known systems, when a blank exiting the press after the pressing operation is large and extends beyond the press, it is supported by a catching conveyor prior to its being severed from the parent material. This catching conveyor generally cannot be stopped and started with the receiving of successive blanks since the exit speed of the blanks including the acceleration rate for the conveyor are too high to drive the belts of the catching conveyor in a practical manner. Also, since this catching conveyor cannot be operated at the same rate of speed as the speed of the exiting blank, invariably damage or scratching to the blank occurs.

Some of these adverse conditions also occur in handling short blanks which must be quickly decelerated because of space requirements, and yet the deceleration and stoppage must be controlled to avoid any ojectionable markings.

It is, therefore, an object of the present invention to provide in an arrangement for a press feed line, a means and method for handling blanks exiting the press at high rates of speed in a manner that the speed upon their exit is decelerated in a controlled manner so that each blank is allowed to safely drop onto a catching conveyor thereby resisting any scratching or damaging of the blank.

More particularly, a magnetic conveyor unit is provided immediately adjacent to the exit side of the press for picking up the blank and then conveying it to a catching conveyor. The magnetic conveyor unit comprises a plurality of anti-frictional, low inertial, non-driven rollers and an array of electromagnets located inwardly of the rollers such that the electromagnets pick up the blank, with only the surface of the rollers coming into direct contact with the blank. The rollers and electromagnets are mounted on a plurality of rail or carrier assemblies which are individually operated and adjusted to conform to the face of the die in the press for optimum support of the blank.

From the catching conveyor the blanks must then be neatly and automatically stacked with minimum side variations, with the center of the blank being aligned with the center of the pallet on a stacker car. Also, it is desirable to position the pallet on the stacker car prior to the pallet's removal therefrom so that the center of the stacked blanks is such that the stack can be easily received and handled by equipment downstream of the press area.

It is a further object of the present invention to provide means which lends the stacking process to robotic treatment which neatly forms the stacks, and maintains the neatly formed stacks on the pallet. This is especially important in the instance where the blanks take many different shapes, some of which are small, polymorphic shapes. A specially designed stacker car aids in this stacking process and permits different positioning of the pallet in the stacking station.

Depending on the type of press and the design of the die therein, blanks may be discharged from the top and/or bottom surfaces of the die.

It is a still further object of the present invention to provide an arrangement in a press feed line for receiving a blank from two different locations or sources in the press either at the same time servicing several stacking stations, or at different time intervals servicing alternate stacking stations.

In a broad application, it is a further object of the present invention to provide an arrangement in a press feed line for handling blanks, that can be fully automated and computer controlled to handle and stack blanks of a large range of sizes and shapes at optimum speeds, ease, and efficiency.

BRIEF DESCRIPTION OF THE DRAWINGS

These objects, features, and advantages as well as others of the present invention will be better appreciated and understood from the following detailed description of the several preferred embodiments, the appended claims, and the accompanying drawings in which:

DETAILED DESCRIPTION OF THE DRAWINGS

The present invention involves several embodiments for handling metallic parts issuing from a press, which parts may for example be blanks or stamped in the form of side panels, bumpers, etc. for automobiles. A coil of steel strip weighing over 75,000 pounds may be fed into the press and the blank or stamped portion caused to be discharged from the dies in the press at a maximum rate of 60 parts per minute. The blank or stamped portion, still connected to the parent coil is pushed out of the press and severed therefrom by the dies at a speed equivalent to its thrust received from the parent coil. The several embodiments provide for an arrangement located adjacent a press, which arrangement comprises a conveying system in conjunction with a stacking system for picking up, transporting, and stacking these blanks shortly after being severed and exiting the press. These severed metallic blanks generally travel at high rates of speed and are adequately handled by the embodiments described herein.

A PREFERRED FIRST EMBODIMENT

Figure 1A:
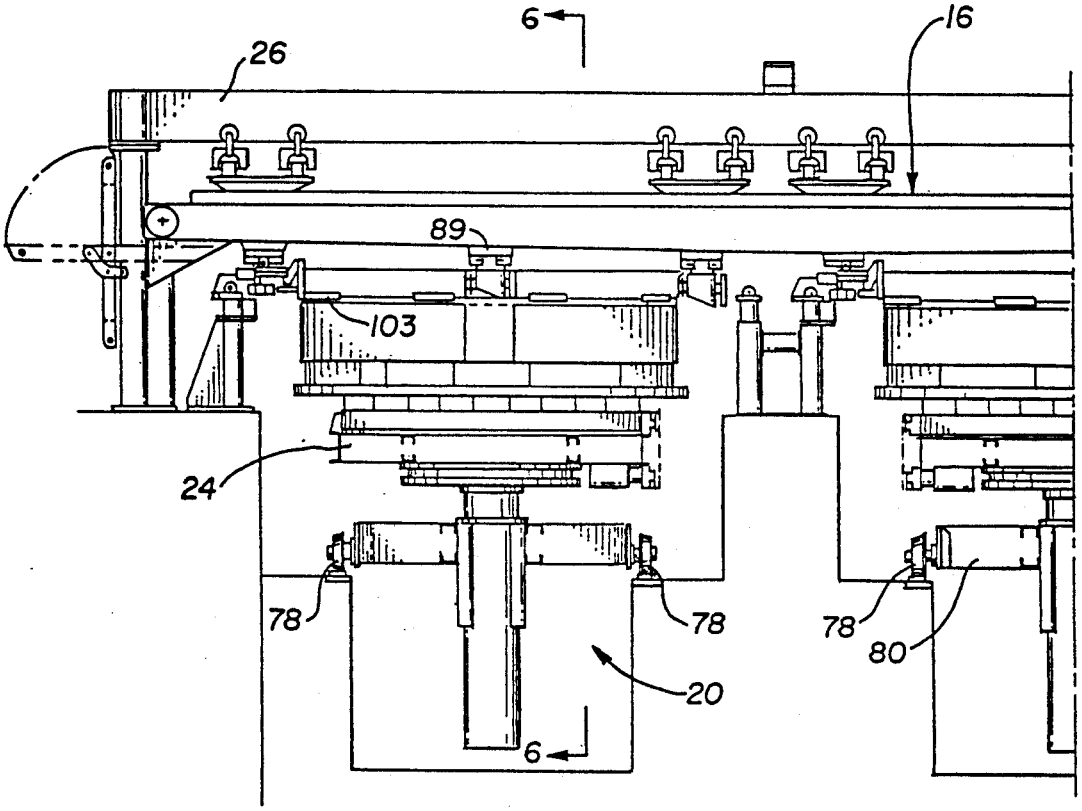
FIGS. 1A and 1B are partial views which together depict an elevational view of an arrangement for conveying and stacking blanks and is a first embodiment of the present invention.

FIGS. 1A-7B represent a first embodiment of the present invention. With particular reference to FIGS. 1A-1B, there is shown going from right to left of press 10, a magnetic pick-up conveyor unit 12, a catching conveyor 14, an overhead magnetic conveyor unit 16, and stacking stations 18 and 20, each having a stacker car 22, 24, respectively. The arrow in FIG. 1B indicates the direction of travel of the blank exiting the press 10.

Figure 1B:
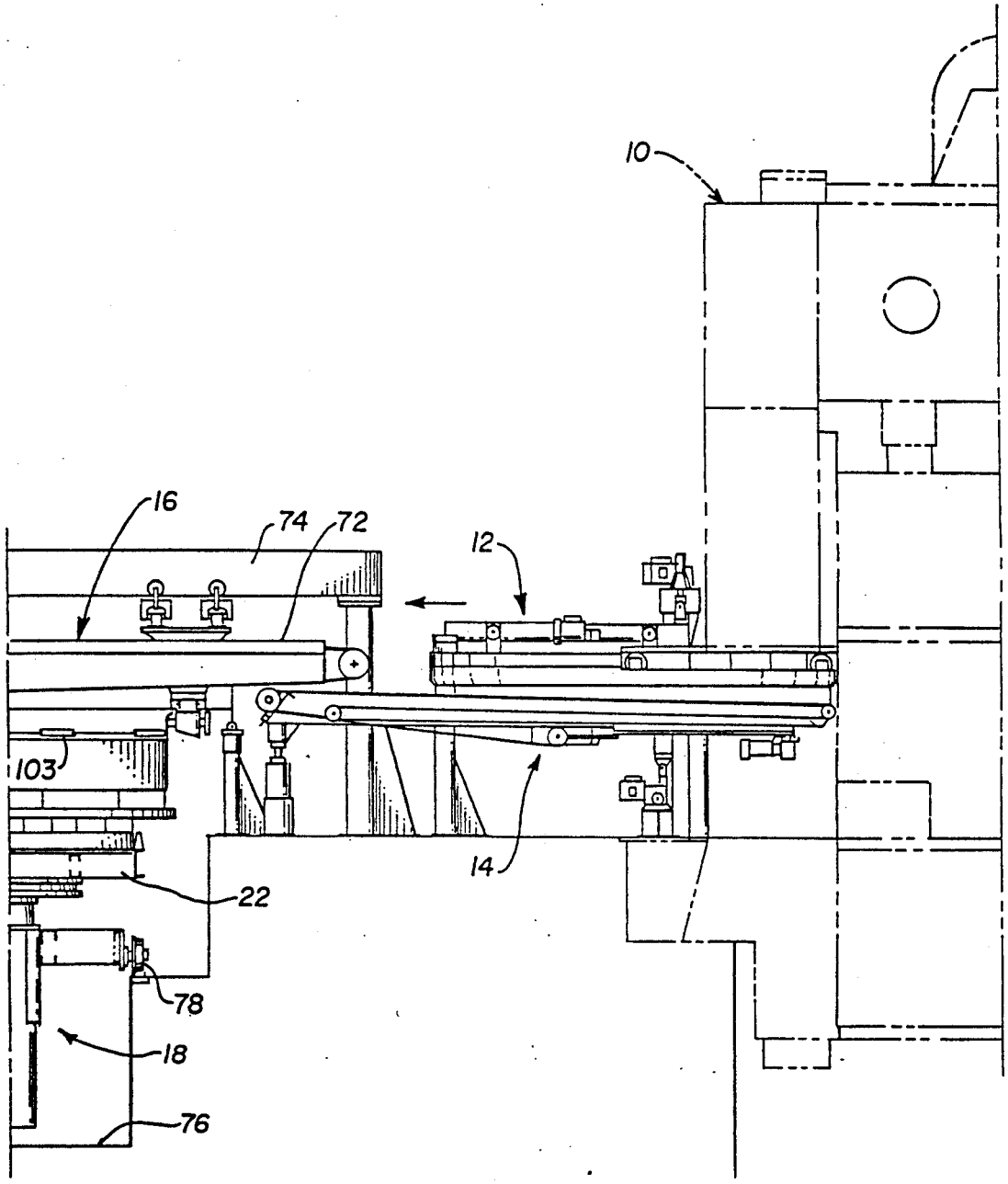
Figure 3:
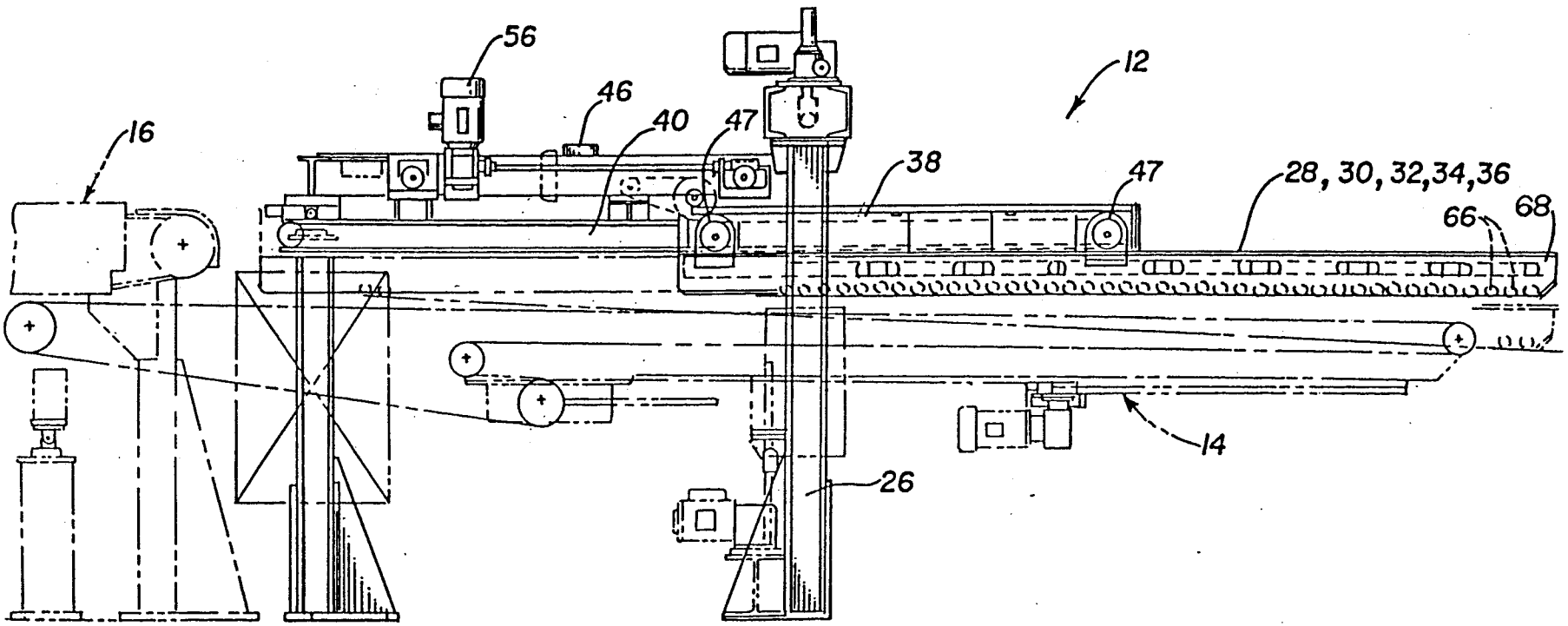
FIG. 3 is an elevational, detail view of a magnetic pick-up conveyor unit located near the exit end of a press as shown in FIGS. 1A–1B, and schematically illustrates a catching conveyor unit and part of an overhead magnetic conveyor unit.

FIG. 1B illustrates schematically both magnetic pick-up conveyor unit 12 and catching conveyor unit 14 extending into press 10 between which a passline is created representing a path of travel for the blank in the direction indicated by the arrow upon its exit from a die in the press. FIG. 3 shows in detail both units 12 and 14 in an extendable mode. The blank is carried by the conveyor unit 12, dropped onto catching conveyor unit 14, picked up by the overhead magnetic conveyor unit 16, and then placed on stacker car 22, 24 in station 18, 20.

Some of the more important features for the construction of upper magnetic conveyor unit 12 and its cooperation with the lower catching conveyor unit 14 are shown in FIGS. 3, 4, 5, and 5A. Lower conveyor unit 14, as well as overhead magnetic conveyor unit 16, may be conventional designs, and may follow the teachings disclosed in the above-stated U.S. Pat. Nos. 2,374,174; 3,020,810; and 3,369,806, incorporated herein by reference; whereas magnetic conveyor unit 12 is part of the present invention, and therefore will be discussed more fully.

Figure 4:
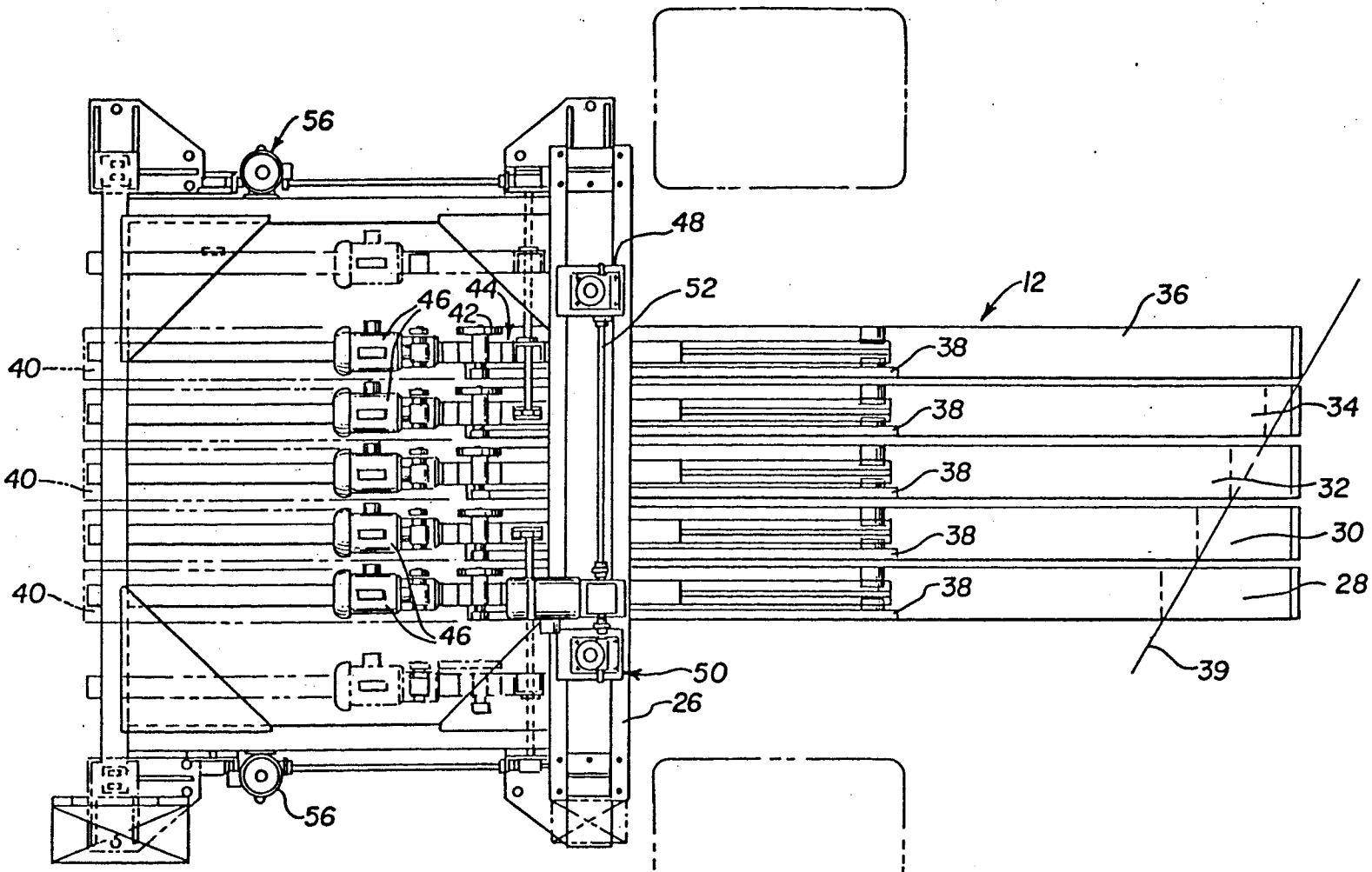
FIG. 4 is a plan view of FIG. 3 showing only the magnetic pick-up conveyor unit.

As shown in FIGS. 1A-5 conveyor unit 12 is mounted on a structural assembly 26 consisting of the several vertical members and horizontal members, and consists of a plurality of rail or carrier assemblies 28, 30, 32, 34, 36, each independently operated for movement into and out of the press 10, which allows each rail assembly to be adjusted so that all the rail assemblies may form a configuration corresponding to the die in the press or to the blank in order to facilitate optimum engagement of the blank by the carrier assemblies 28-36. This ability for each rail assembly 28, 30, 32, 34, 36 to be moved to form a configuration corresponding to the blank or die is indicated in FIG. 4 by a diagonal line 39 appearing toward the right of this FIGURE.

Each rail assembly 28-36 is supported on structural assembly 26 by structural members 38 and 40 (FIG. 3), and is reciprocated in a longitudinal direction toward and away from the press 10 by pinion 42 and rack 44 (FIGS. 4 and 5A) on structural member 38, which pinion 42 is activated through bushing 43 by motor drive assembly 46 mounted on horizontal member 40 as particularly shown in FIG. 4.

Figure 5:
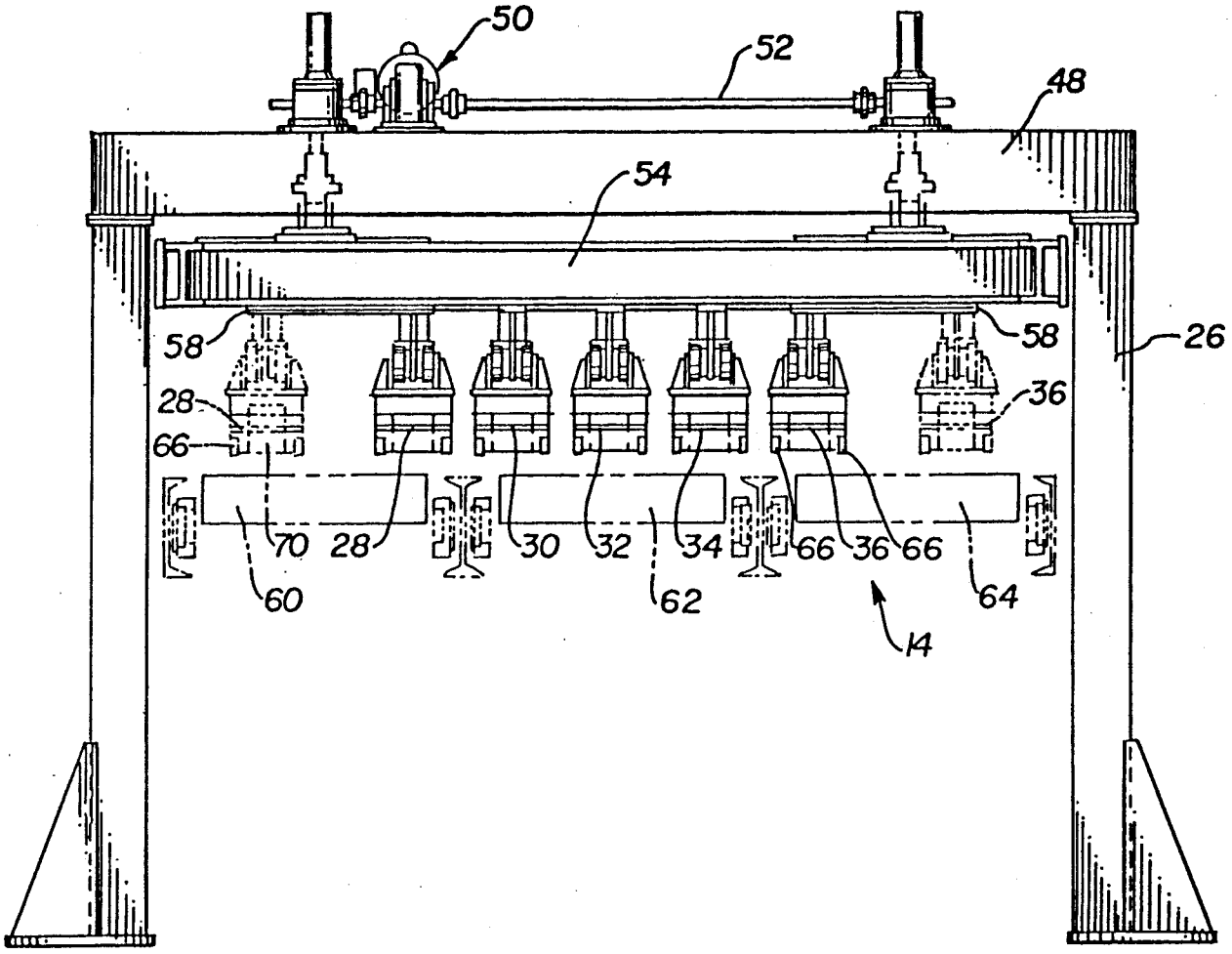
FIG. 5 is an elevational view of FIG. 4.
Figure 5A:
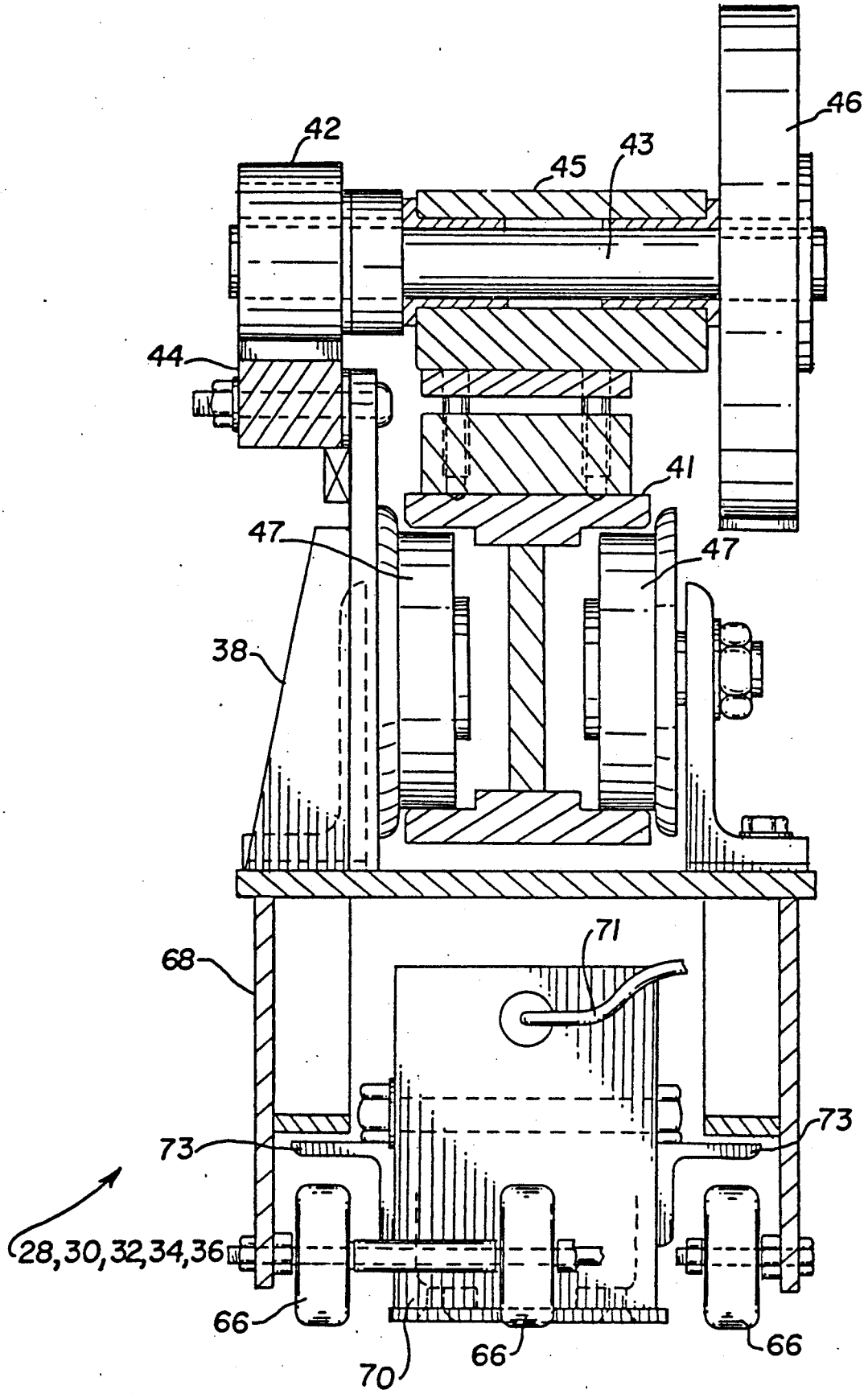
FIG. 5A is an enlarged cross-sectional view of one of the carrier assemblies of FIG. 5.

FIG. 5A particularly shows the construction of each rail assembly 28-36. Drive assembly 46 is connected to pinion 42 by a member 43 and bushing 45. Rack 44 is mounted to member 38 connected to member 68. Mounted to member 38 are freely rotatable wheels 47 which rotatably engage and are guided by member 41 mounted from bushing 45. Still referring to FIG. 5A, freely rotatable rollers 66 are mounted to member 68 as shown and mounted between the rollers 66 in a longitudinal direction. Along the length of member 68 is an array of electromagnets, more about which will be discussed shortly.

As particularly shown in FIGS. 4 and 5, mounted atop structural assembly 26 extending into horizontal member 48 is a motor-screw jack assembly 50 with a common tailshaft 52. Motor-screw assembly 50 is connected to a horizontal member 54 which member 54 supports rail assemblies 28, 30, 32, 34 and 36. This construction allows tilting and thus lowering of the rail assemblies 28–36, relative to the press 10 to accommodate the varying range of the passline of the blank. This tilting action is shown toward the right in FIG. 3 by the phantom positioning of the rail assembly 28.

Outer rail assemblies 28 and 36, as particularly shown in FIG. 4, are each movable towards and away from the inner rail assemblies 30–34 and thus laterally with respect to the path of the blank through motor drive assembly 56 mounted on structural assembly 26. As FIG. 5 shows, outer rail assemblies 28, 36 are mounted to horizontal member 54 in a slide 58 for their reciprocation in a lateral direction toward and away from inner rail assemblies; whereas inner assemblies 30, 32, 34 are fixed to horizontal member 54.

This transverse movement of rail assemblies 28 and 36 accommodates the varying widths or lengths of the blank exiting the press. FIG. 5 illustrates in phantom that rail assemblies 28 and 36 are positionable to cover the transverse edges of the catching conveyor unit 14, consisting of belt conveyors 60, 62, 64.

As mentioned above, each rail assembly 28–36 through its individual motor drive assembly 46 can be extended into the press 10 in a manner that the overall formation of the assemblies 28–36 conform to the shape of the die in order to provide a close proximity between the entry point of the pick-up of the blank by the rail assemblies and the contour of the die. Outer rail assemblies 28 and 36 can then be spaced away from inner rail assemblies 30–34 to accommodate the length of the die and still retaining their previous longitudinal positioning for the shorter, same shaped blank.

Referring again to FIGS. 3, 4, 5 and 5A, and with particular reference to FIGS. 3, 5, and 5A, each rail assembly 28–36 comprises a series of low inertial non-driven rollers 66 (best shown in FIG. 5A) mounted through suitable means to structural member 68. FIGS. 3 and 5A illustrate a plurality of rollers 66 being mounted along the length and width of member 68. Between the several rollers 66 along the length of horizontal member 68 is an array of electromagnets 70 which are selectively activated through suitable means 71 to either carry or drop a blank. As shown toward the bottom of FIG. 5A each electromagnet 70 is constructed to be located inwardly from the surface of rollers 66 so that when a blank exits the press 10, it is picked up through activation of the electromagnet 70 and only the surfaces of rollers 66 come into direct contact with the blank. As FIG. 5A shows, electromagnet 70 is mounted in member 62 through brackets 73 mounted on opposite transverse sides of electromagnets 70, which brackets 73 in turn are mounted to member 68 (not shown).

As mentioned above, rollers 66 and electromagnets 70 are mounted along the entire length of member 68. Energization of electromagnets 70 hold the blank away from belts 60, 62 and 64 of catching conveyor unit 14, and rollers 66 being of low inertia with very little resistance, allow the blank to be pushed forward by the parent material along magnetic pick-up conveyor unit 12 toward the left of FIG. 2, without any buckling occurring to either the blank or the parent material of the coil. The arrow of FIG. 2 indicates the direction of travel for the blank. Shortly after the blank is severed from the parent material by the die, the electromagnets 70 are de-energized thereby allowing the blank to drop onto the bottom catching conveyor unit 14, which unit 14 also contains magnets either electro or permanent for retaining the blank thereon as will be discussed shortly.

In a blank carrying mode of rail assemblies 28, 30, 32, 34, and 36, where the electromagnets 70 pick up the blank and the blank is held against the rollers 66, the blank initially after its exit from the press 10, travels generally at the same rate of speed along the surfaces of the low inertia rollers 66 as its rate of speed at its exit from the press for a certain length of time until it eventually reduces its speed during its travel. Since little or no resistive force is exerted against the blank by the freely rotatable rollers 66, the speed of the blank is allowed to be reduced on its own accord.

It is to be appreciated that usually the blank is still attached to the parent material, and the feed rollers in the press feed the attached blank at a certain rate of speed. The rollers 66 are driven by the blank at the same rate of speed as the blank; in some press line operations, immediately upon the blank's being severed from the material, the blank is caused to be dropped by the magnetic pick-up conveyor 12. As the blank speed is reduced the electromagnets 70 can be de-energized as mentioned above, which de-energization can be progressively effected for each electromagnet 70 along the blank's path of travel.

Since no appreciable speed differential exists between the blank upon its exit from the press and the magnetic pick-up conveyor unit 12, the chances of damaging or scratching the blank are reduced. Catching conveyor unit 14 can then be driven at a speed within the practical limits of its design, which speed in most instances, is extremely low compared to the press exit speed of the blank.

Each rail assembly 28–36 may be extended into the press 10 in a fashion conforming to the shape of the blank, thus providing an optimization of the pick-up process for the blank, i.e. total support of every portion of the blank by electromagnets 70 is provided, regardless of whether the blank is regularly or irregularly shaped.

FIGS. 1B, 3, and 5, show catching conveyor unit 14 as being located beneath magnetic pick-up conveyor unit 12. Conveyance unit 14 in the form shown consists of belt conveyors 60, 62, 64 as particularly shown in FIG. 5.

FIG. 1B particularly shows conveyor unit 14 as being in a position corresponding to the positioning of rail assemblies 28–36 of magnetic pick-up conveyor unit 12, whereas FIG. 3 shows conveyor unit 14 extended to substantially correspond to the length of the rail assemblies. The adjustment for the lengths of rail assemblies 28–36 and conveyor unit 14 particularly comes into play when a short blank is processed in the press whereupon both rail assemblies 28–36 and conveyor unit 14 extend into the press to accommodate the shorter blank.

The construction and operation of catching conveyor unit 14 may generally follow well known practice, for instance, such as that disclosed in U.S. Pat. No. 3,617,052, which is incorporated herein by reference. As was true with respect to rail assemblies 28–36, in order to attain a close proximity to the die in the press, each conveyor belt 60, 62, 64 can be adjusted longitudinally for its location near the die, and can be adjusted laterally to accommodate the length of the die. Also, each belt conveyor 60, 62, 64 can be raised and lowered to accommodate the varying pass line for the blank in the press 10. Conveyors 60, 62, 64 can be driven from a common motor assembly to insure speed synchronization thereof, and either electro or permanent magnets can be mounted beneath the belts to securely hold the blank thereon released by the above conveyor unit 12 in order to resist slippage of the blank on the conveyor unit 14.

After the blank is dropped on catching conveyor unit 14, it is transported to the left in FIG. 1B to overhead magnetic conveyor unit 16 where it is picked up on the conveyor unit 16 by its underside and is placed on a stacking car 22, 24 in stations 18, 20 (FIGS. 1A and 1B). A stacker car 22, 24 supporting a pallet is shown in detail in FIG. 6, as will be discussed hereinafter.

Figure 2:
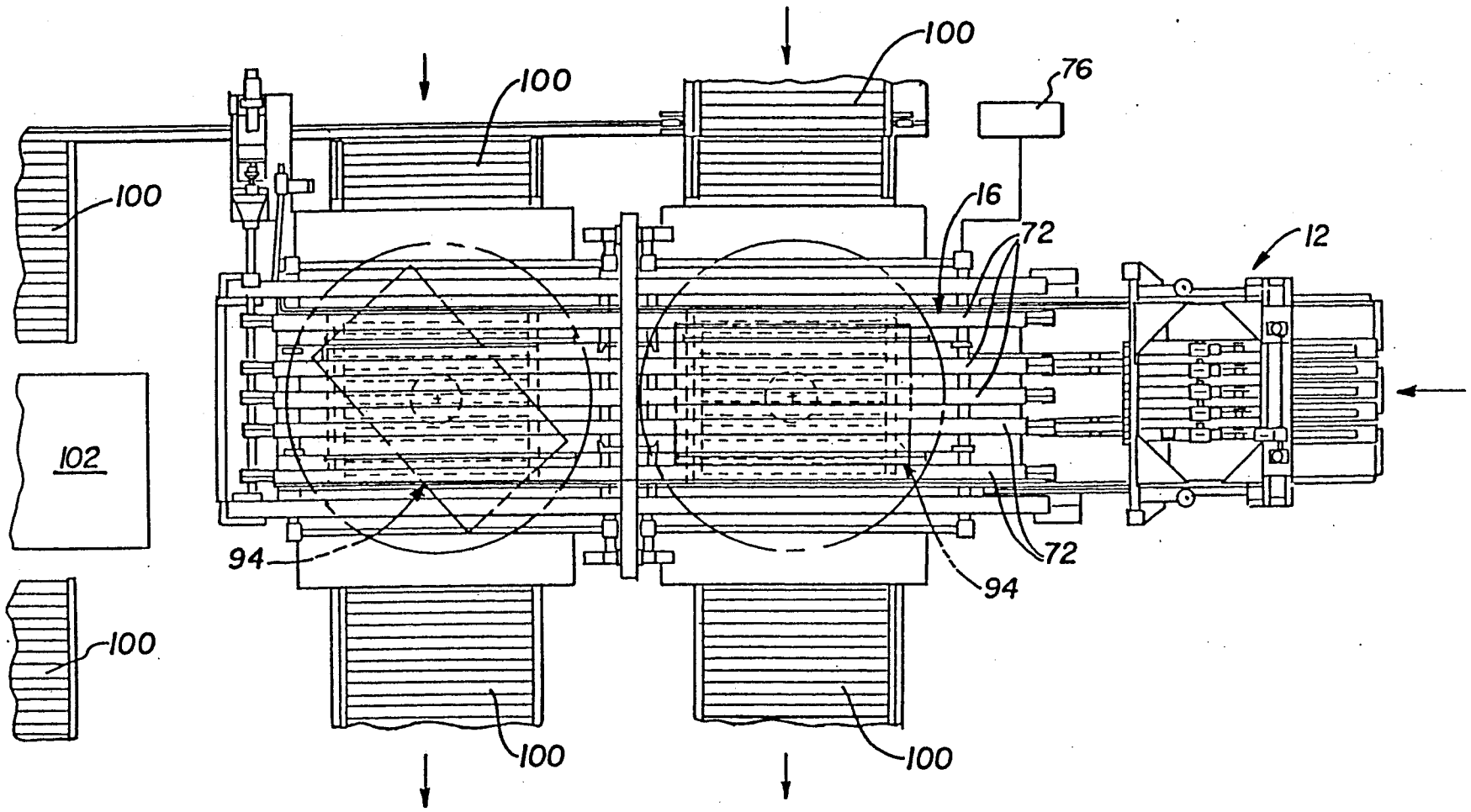
FIG. 2 is a plan view of FIGS. 1A–1B showing the positioning of the pallet on each stacker car and deleting some of the components for clarity.

Overhead conveyor unit 16 may generally follow well known designs such as that disclosed in U.S. Pat. Nos. 2,374,174 and 3,617,052. As shown in FIGS. 1A, 1B, and 2, as particularly shown in FIG. 2, conveyor unit 16 consists of the several belt assemblies 72. These belt assemblies 72 are synchronously driven through a motor drive assembly (not shown). A bed or array of magnets, either permanent or electromagnets, are located on the underside of the belt of each assembly 72 in a manner that the belts come into direct contact with the blank for its transportation to the appropriate stacking station 18, 20.

This overhead conveyor unit 16 may be similar in design to the magnetic pick up conveyor unit 12 in that each belt assembly 72 may be moved longitudinally and laterally with respect to the path of travel of the blank to accommodate the dimensions of the blank. This ability to adjust each belt assembly 72 to conform to the shape of the blank enhances the control for accurately depositing the blank in stacking station 18, 20, in that, the entire leading edge of a blank is released at the same time, thus resisting skewing or twisting of the blank which may occur in the instance where the magnets are in a straight formation attracting a substantial or entire undersurface of the blank.

In order to guide the blank into stacking station 18, 20 conveyor unit 16 consists of a guide-end stop-back stop system mounted on structural assembly 74 particularly shown in FIGS. 1A, 1B, 7A and 7B, as will be discussed herein. Other structural features and operation of this conveyor unit 16 are well known in conveyor handling systems, such as that in U.S. Pat. Nos. 2,374,174 and 3,617,052, and therefore, only the guiding, end stop, and back stop system 75 of FIGS. 7A and 7B will be discussed to some extent. It is to be appreciated that system 75 shown in FIGS. 7A and 7B services only one stacking station 18, 20; and that a similar system 75 services the other stacking station of the present invention. Some design features of the system 75 shown in FIGS. 7A and 7B may differ, but the general principles and operation of the end and back stop system disclosed in the U.S. Pat. No. 3,617,052 are similar to the system 75 shown herein. Other guiding systems are disclosed in U.S. Pat. Nos. 2,761,682; 3,256,011; and 3,369,806.

Figure 6:
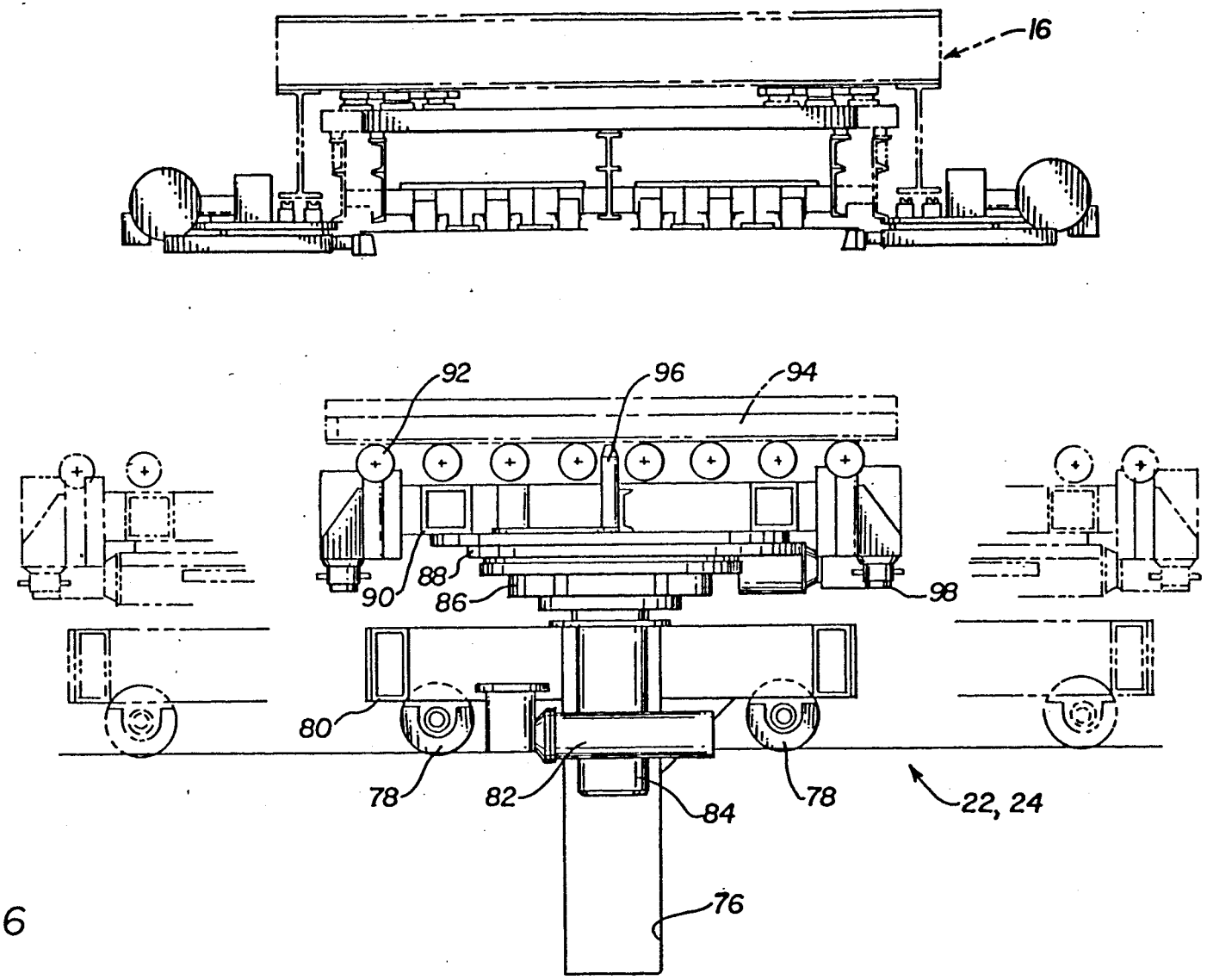
FIG. 6 is an enlarged, detail cross-sectional view of a stacker car and overhead magnetic conveyor unit taken along line 6—6 in FIG. 1A and showing phantom positionings for the stacker car.
Figure 7A:
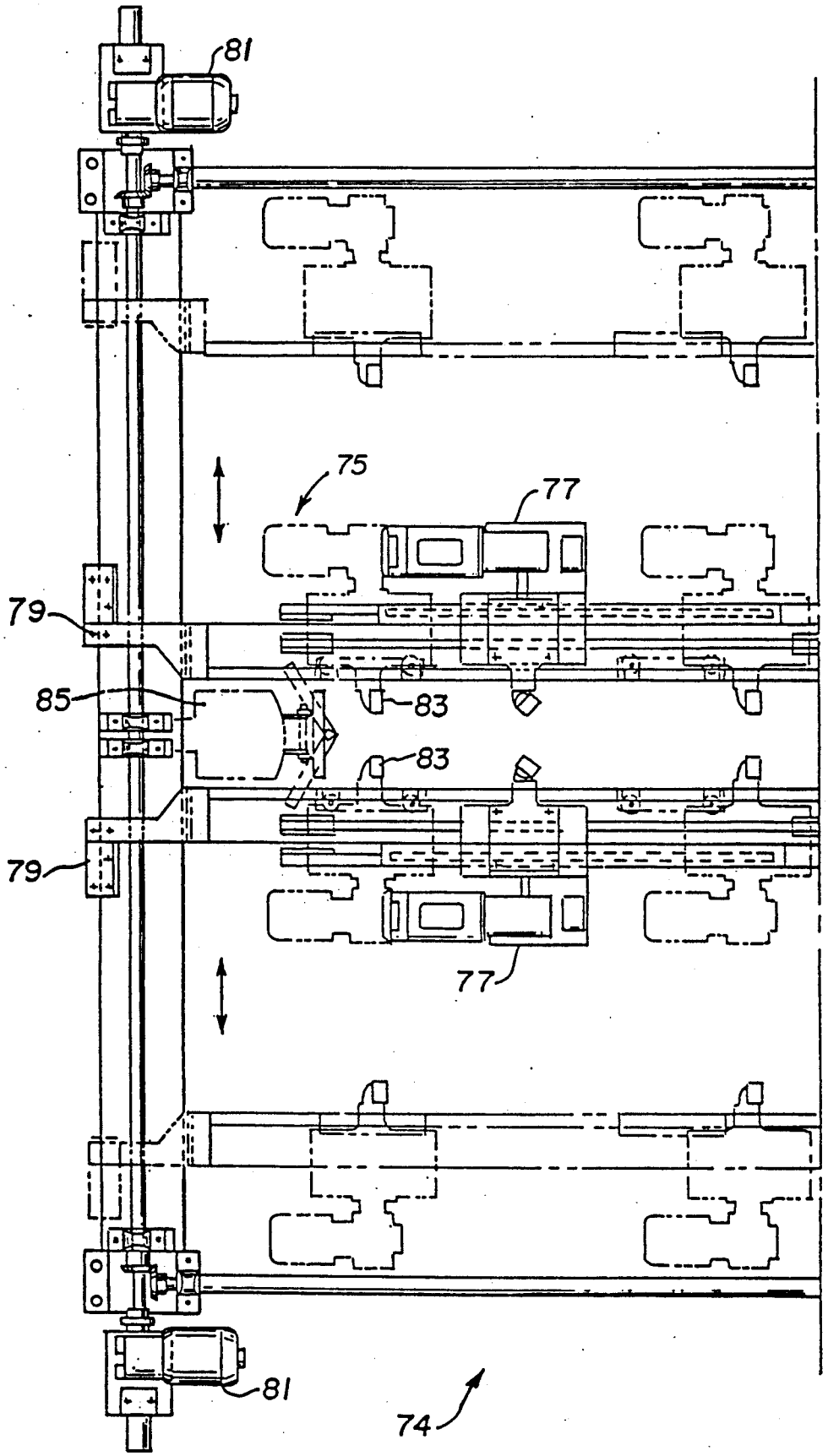
FIGS. 7A-7B are partial views which together depict an enlarged plan view of the guiding, back stop, and end stop mechanisms servicing a stacker station to the far right of FIGS. 1A-1B.
Figure 7B:
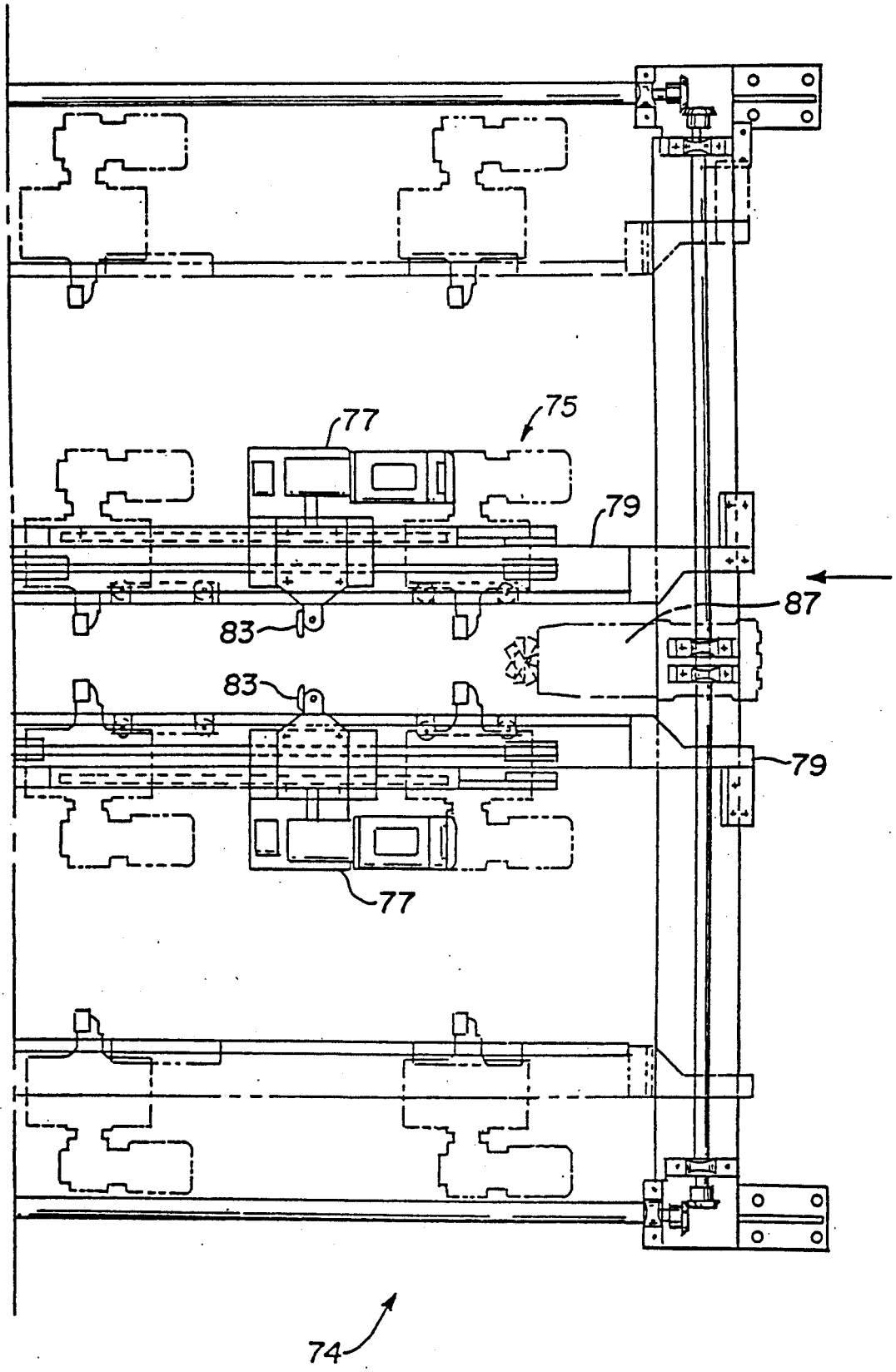

In referring to FIGS. 7A and 7B, side guides 77 guide the blanks in a transverse direction relative to the length of conveyor unit 16 to form neat stacks in stacking station 18, 20. Each side guide 77 is mounted on member 79 which is individually adjusted to coincide with the width or length of the blanks by a motor-screw arrangement 81. Motor screw arrangement 81 provides for movement of members 79 and side guides 77 are movable on members 79 as shown in phantom in FIGS. 7A and 7B, where two phantom postionings for each side guide 77 are shown. Each side guide 77 also contains a pivotable face plate 83. Also mounted to structural assembly 74 is an end stop 85 located to the left of FIG. 7A and a back stop 87 to the right of FIG. 7B. According to known practice, end stop 85 contacts the leading end of the blank; the back stop 87 contacts the trailing end; and the side guides 77 cooperate in guiding the edges of the blank as it is dropped by the conveyor assemblies 72 onto the stacker car 22, 24 (FIG. 6) for the stacking process. Also in the usual fashion, a proximity switch is associated with the stacker car to automatically lower the stacker car 22, 24, and thus, the stack of blanks, as the height of the stack increases in the stacking process.

The structural assembly 74 shown in FIGS. 7A–7B, is part of the assembly for supporting conveyor unit 16 and the guiding-stop system 75 for the other stacking station 18, 20. The arrow to the far right of FIG. 7B indicates the direction or travel for the blank, and the double arrows indicate movement of members 79 and guides 77. If more than one stack of blanks is to be made in a stacking station 18, 20, then the back stop can be adjusted as shown in phantom at 89 in FIG. 1A, and the guides 77 of the respective system 75 can then act as end and back stops for the other stack.

As FIGS. 1A–1B show, stacker car 22, 24 is positioned over a pit 76 and supported on the floor line by wheels 78 mounted on base member 80. The description of each stacker car 22, 24 will be given with reference to FIG. 6. Movement of stacker car 22, 24 in a perpendicular direction relative to the length of overhead conveyor unit 16 is undertaken through operation of motor assembly 82 mounted on car 22, 24. A piston cylinder assembly 84 in base member 80 and extending into the pit 76, raises and lowers the upper portion of stacker car 22, 24. Upwardly from base member 80 are members 86, 88 and 90. Atop member 90 is a plurality of driven rollers 92, one of which is numbered in FIG. 6. Rollers 92 receive and position an empty pallet 94 from feed line in a direction as indicated by the top arrows in FIG. 2, and which rollers 92 discharge a full pallet with the stack or stacks of blanks into the feed line in a direction as indicated by the arrows to the bottom of FIG. 2. The arrow to the right of FIG. 2 represents the path of travel for the blank into the stacking area.

Still referring to FIG. 6, when pallet 94 is positioned on the rollers 92 of stacker car 22, 24 its centerline through rotation of the rollers 92 can be made to correspond to the centerline of the stacker car or it can be made to be off-centered in any desired positioning similar to the angular positioning shown in FIG. 2 by rotation of member 90. Such angular positioning or off-centering of the stacks of blanks on pallet 94 may be required for the downstream equipment in the feed line.

Still referring to FIG. 6, the centerline positioning of pallet 94 relative to member 90 is assured through several pins, only one of which is shown at 96, and which pin 96 as shown is in a position prior to its being spring loaded up into pallet 94. These pins 96 are known in the industry, and therefore, little else is to be said about them.

Rotation of member 90 of stacker car 22, 24 is done through motor-gear box assembly 98 which member 90 rotates pallet 94 about a vertical axis for attaining the desired centerline relationship of the pallet with the feed line and lateral movement of stacker car 22, 24, as shown in phantom in FIG. 6 permits the desired centerline relationship of the pallet 94 with the blanks which are to be stacked.

The movements of members 88, 90 in a vertical or rotational direction, as well as the movement of the stacker car 22, 24 in a perpendicular direction relative to the length of the conveyor unit 16 permit the proper alignment of rollers 92 with those several rollers 100 of the press feed shown to the top and bottom of FIG. 2. Rollers 100 are also driven for the charging of an empty pallet into the stacking station and the discharging of a full pallet therefrom back into the feed line. The representation of the feed line to the far left of FIG. 2, includes an automatically guided vehicle 102 which handles both the pallets and the stacks of blanks in the line. These components and operation of the line are well known to those skilled in the industry and therefore, further explanation is not necessary.

Pallet 94 is always centered accurately on stacker car 22, 24, through the pallet loading system. The stacker car 22, 24 can be shifted as shown in FIG. 6 to obtain an off-centerline positioning for the stacked blanks.

As is known in the art, plunger plates 103, two of which are numbered in FIGS. 1A and 1B, are used to stop the upward motion of stacker car 22, 24 in a stacking position and to resist the blank from sliding beneath the guides 77.

The drive devices for the several degrees of movement for stacker car 22, 24 can be individually controlled by feedback devices (not shown) so that these several positions can be automatically obtained and repeated for the same size and shape of blanks processed at different times once the appropriate data is entered and stored in the memory of a microprocessor unit.

A SECOND PREFERRED EMBODIMENT

An arrangement for a conveying system incorporating some or all of the features of the present invention as described above is shown in FIGS. 8 and 8A, which arrangement has stacking stations 104, 106, 108 and 110. Upper conveyor unit 112 consists of conveyor units A, B, C, and D and services stations 108 and 110. Lower conveyor unit 114 consists of conveyor units E and F and services stations 104 and 106. Both conveyor units 112 and 114 are designed to be moved vertically to be aligned with the top and bottom of the dies in the press, thus enabling at least two blanks to be removed from the press at the same time, conveyed, and then stacked in an appropriate stacking station serviced by the upper and lower conveyors units 112, 114, respectively.

The stacker car in the stacking stations 104–110 may be constructed similarly to that shown in FIG. 6 and may have a similar charging and discharging pallet system as described in the first preferred embodiment. Conveyor units B, C and D and conveyor unit F of upper and lower conveyor units 112 and 114 respectively may be constructed similarly to the overhead magnetic conveyor unit 16 and located near the exit end of the press 10. Conveyor units A and E are catching conveyors similar to that of the first embodiment, and are generally located in and part of press 10. As shown in FIG. 8A, conveyor unit B consists of several conveyor belt assemblies 116, 118, 120, 122, 124 and 126, and conveyor unit D consists of belt assemblies 115, 117, 119, 121, 123, and 125. As indicated to the right of FIG. 8A, assemblies 116–126 are longitudinally adjusted to conform to the particular configuration or form of the dies as indicated by the diagonal line 128 to the right of FIG. 8A.

Figure 8:
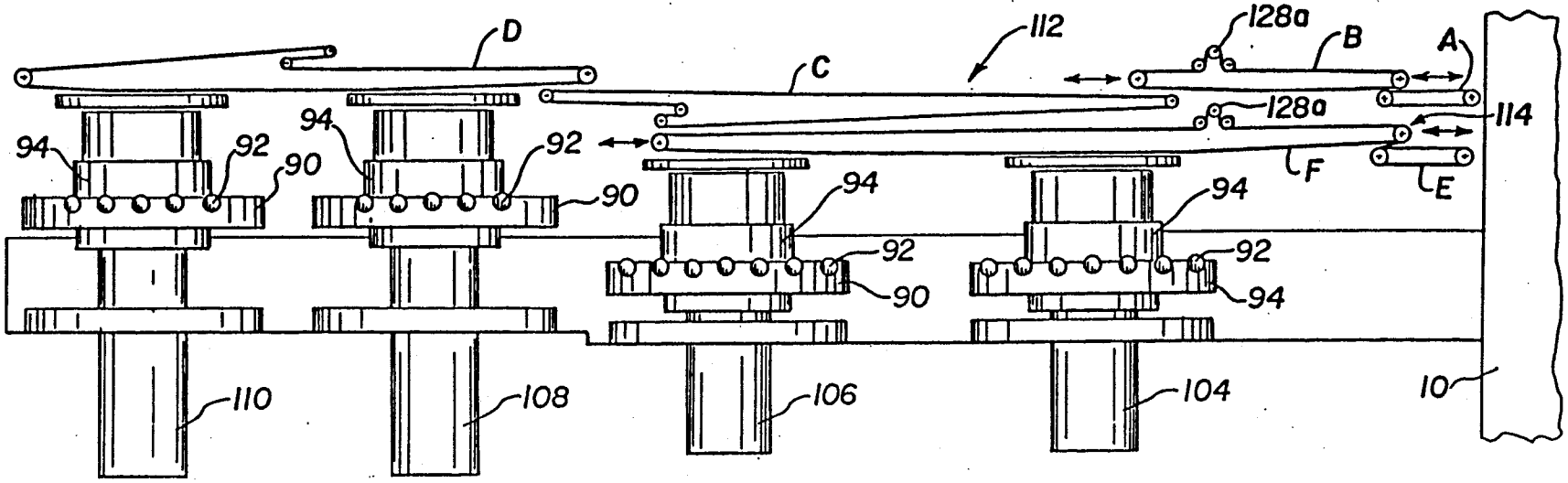
FIG. 8 is a schematic, elevational view of a second embodiment of the present invention showing an arrangement for conveying and stacking blanks in several stacking stations.
Figure 8A:
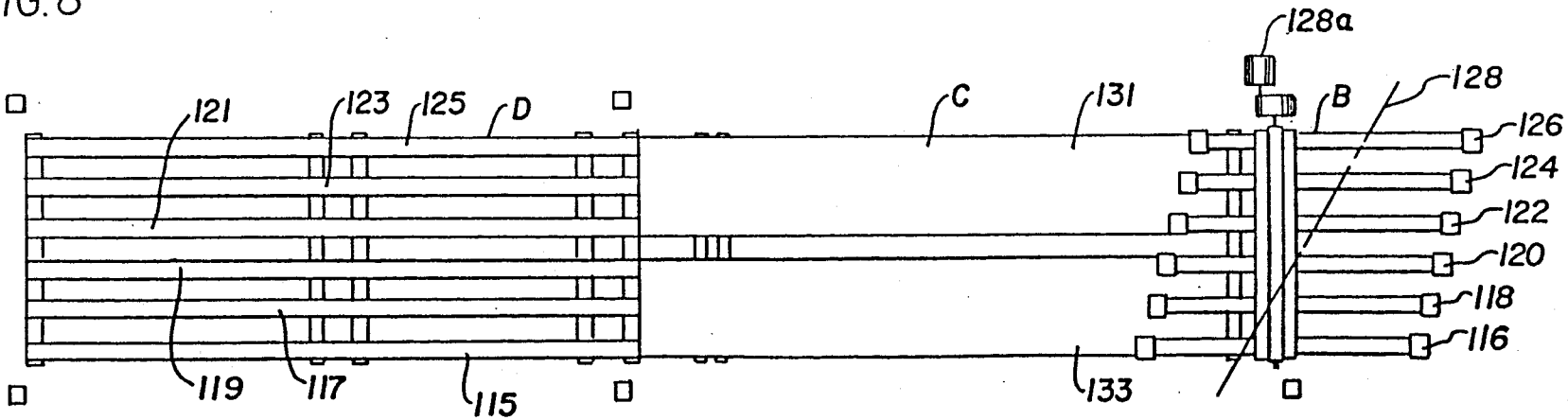
FIG. 8A is a plan view of the conveyor system shown in FIG. 8.

The double arrows to the right of FIG. 8 indicates movement of conveyor unit B. It is to be understood that both conveyor units B and F of upper and lower units 112, 114 respectively are similar in design. Movement of their belt assemblies is brought about through movement of their respective pulley assemblies located at the opposed ends of belt assemblies 116–126 of conveyor unit B, and the opposed ends of those belt assemblies of lower conveyor unit F. The belt assemblies of conveyor units B and F are mounted around a stationary roller drive assembly **128*a* clearly shown in FIG. 8A. Roller drive assembly consists of a common drive roller over which the belts are mounted, which allows for the synchronization of the belts. Drive assembly 128*a* remains stationary while the pulley assemblies at the opposed ends are caused to move toward and away from press 10**.

Conveyor unit C in FIG. 8A consists of two belt conveyors 131 and 133. The several belt conveyors shown in FIGS. 8 and 8A contain magnets, and may be similar in design to those disclosed in the above mentioned patents, apart from the distinctions stated above.

In the stacking operation of this second arrangement, as well as of the first embodiment, member 90 containing rollers 92 with pallet 94 of the stacker car is positioned relative to its respective overhead conveying unit 112, 114 and as the stacking process proceeds, member 90 is gradually lowered to accommodate the increasing height of the stacked blanks.

With regard to the arrangement shown in FIGS. 8–8A, it is to be understood that at least one stacking operation of the blanks can be performed simultaneously by each lower and upper conveyor unit 112, 114, thus making the simultaneous forming of two stacks possible. The ability to form several stacks in conjunction with the full automation of the equipment in the press line results in an increased production rate for the line. This second embodiment differs from the first in that the blank has already been severed from the parent material. The blank is positioned onto conveyor units A and E in the press and transported down the conveyor line. Since the blank has no speed of its own, there is less of a chance of the blank's being damaged.

A THIRD PREFERRED EMBODIMENT

FIGS. 9A–11B illustrate a third arrangement for handling blanks exiting a press with some constructional variations as follows. Like numerals appearing herein represent like elements appearing in FIGS. 1A–8B.

Figure 9A:
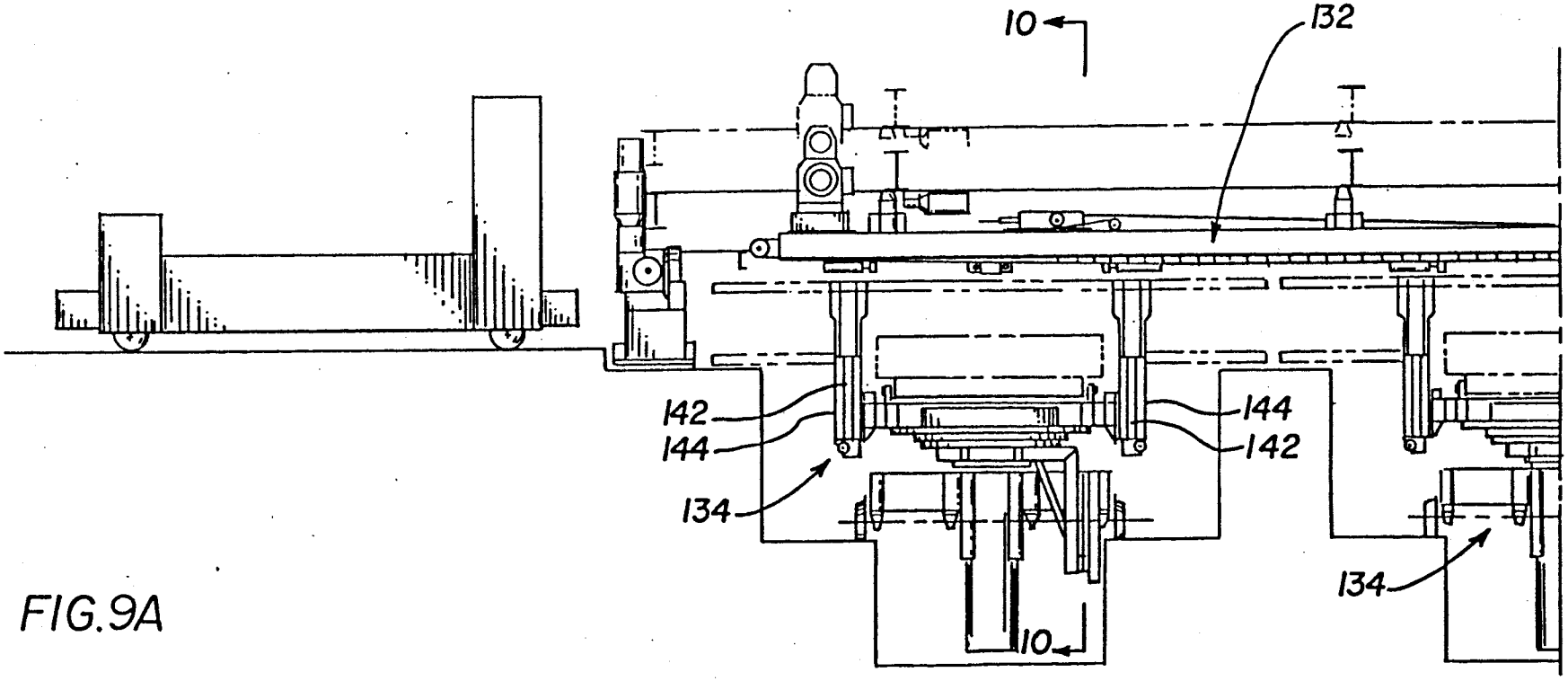
FIGS. 9A and 9B are partial views which together depict an elevational view of part of a third embodiment of the present invention showing an arrangement for conveying and stacking blanks exiting from the end of a press.
Figure 9B:
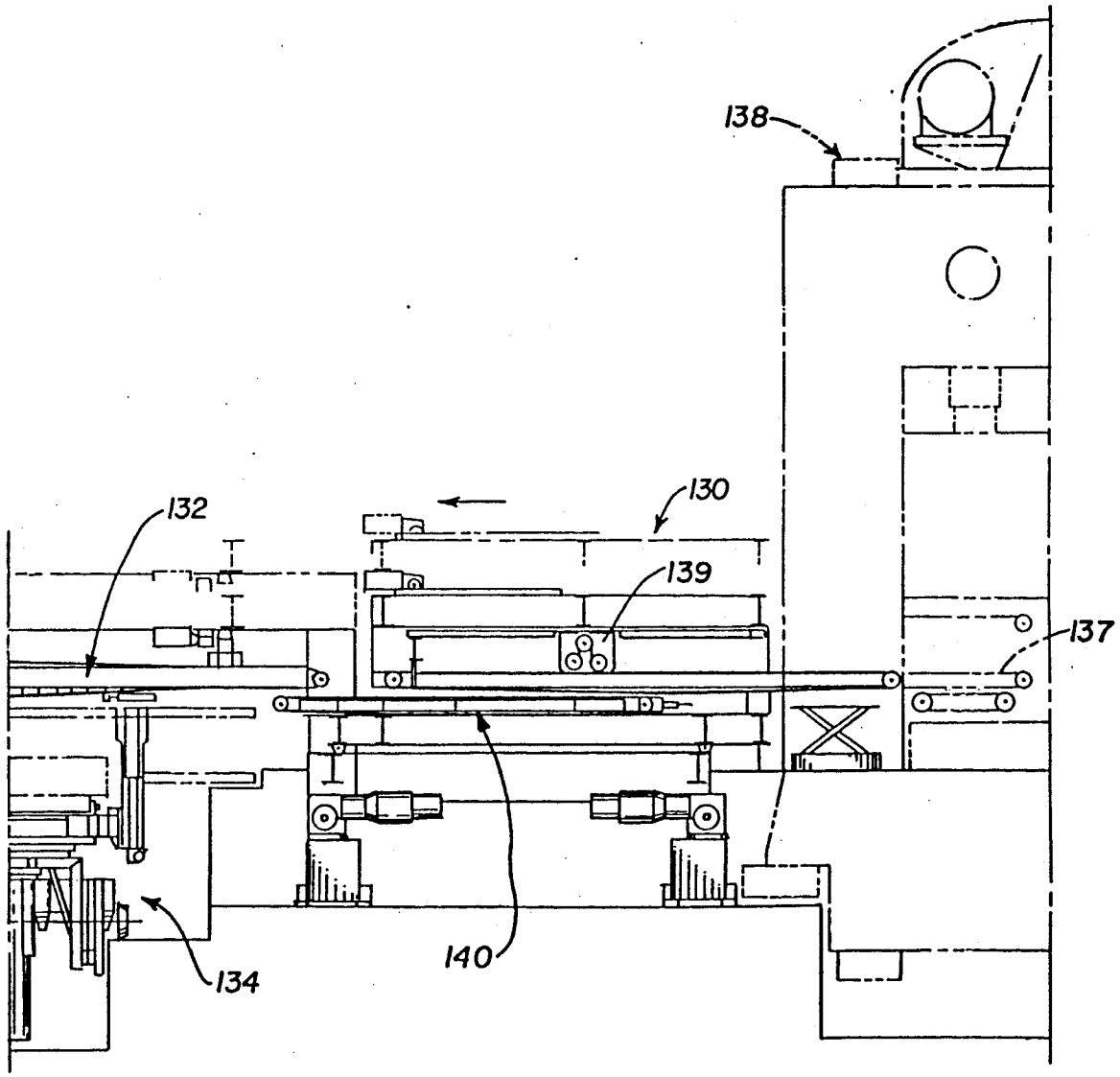

This third embodiment allows the magnetic pick up conveyor unit 130, the overhead magnetic conveyor unit 132, and the stacker cars 134, 136 adjacent the exit end of the press 138 to be raised or lowered through suitable means in alignment with the top and bottom of the dies in press 138. This is shown by the phantom positioning of magnetic pick up conveyor unit 130 and overhead magnetic conveyor unit 132. The arrangement in FIGS. 9A and 9B is located at the exit end of the press and that of FIGS. 11A and 11B is located perpendicularly to that of FIGS. 9A and 9B as shown in FIG. 11D.

Figure 10A:
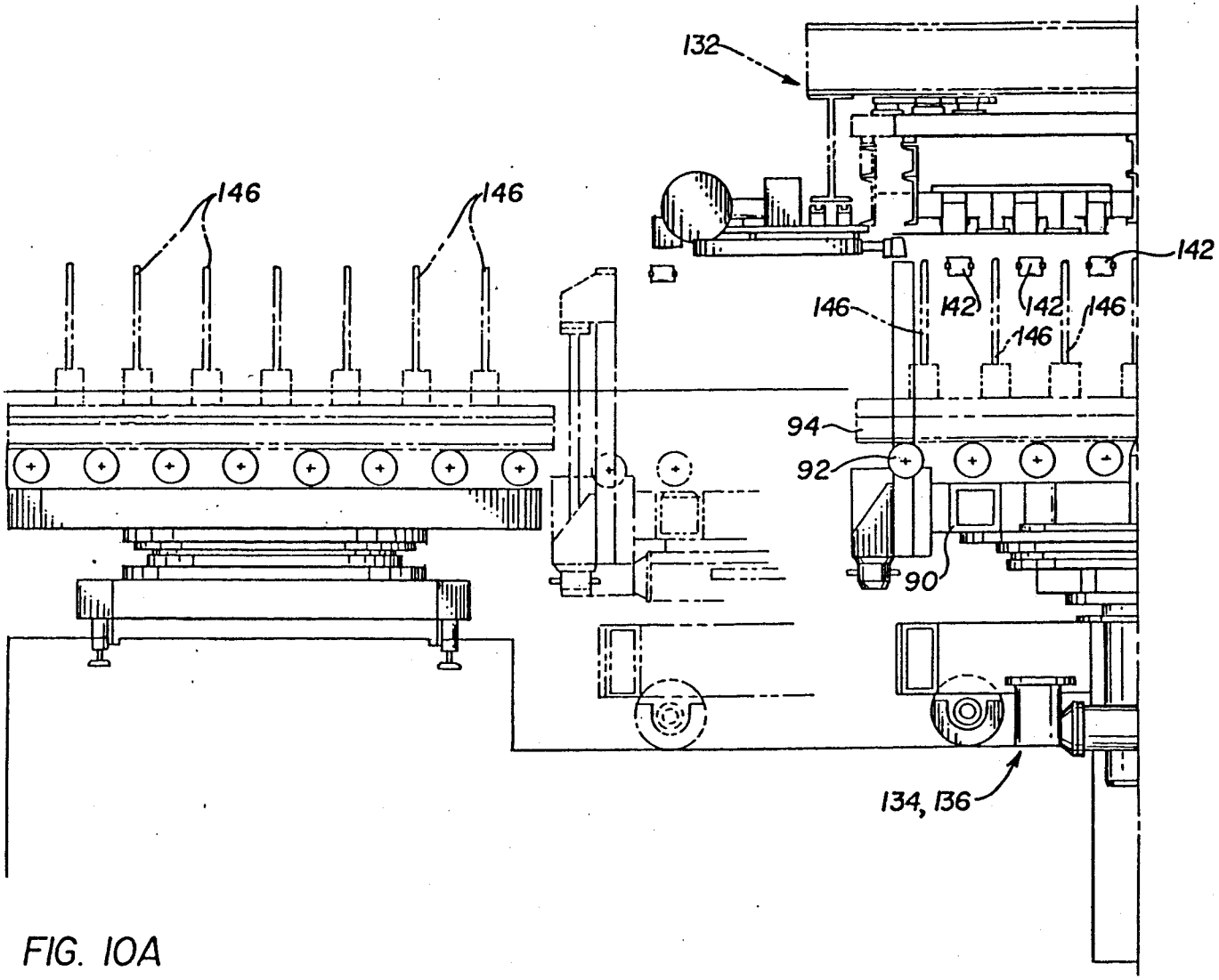
FIGS. 10A and 10B depict an enlarged, detail cross-sectional view of a stacker car taken along line 10—10 of FIGS. 9A-9B, and showing phantom positionings for the stacker car.
Figure 10B:
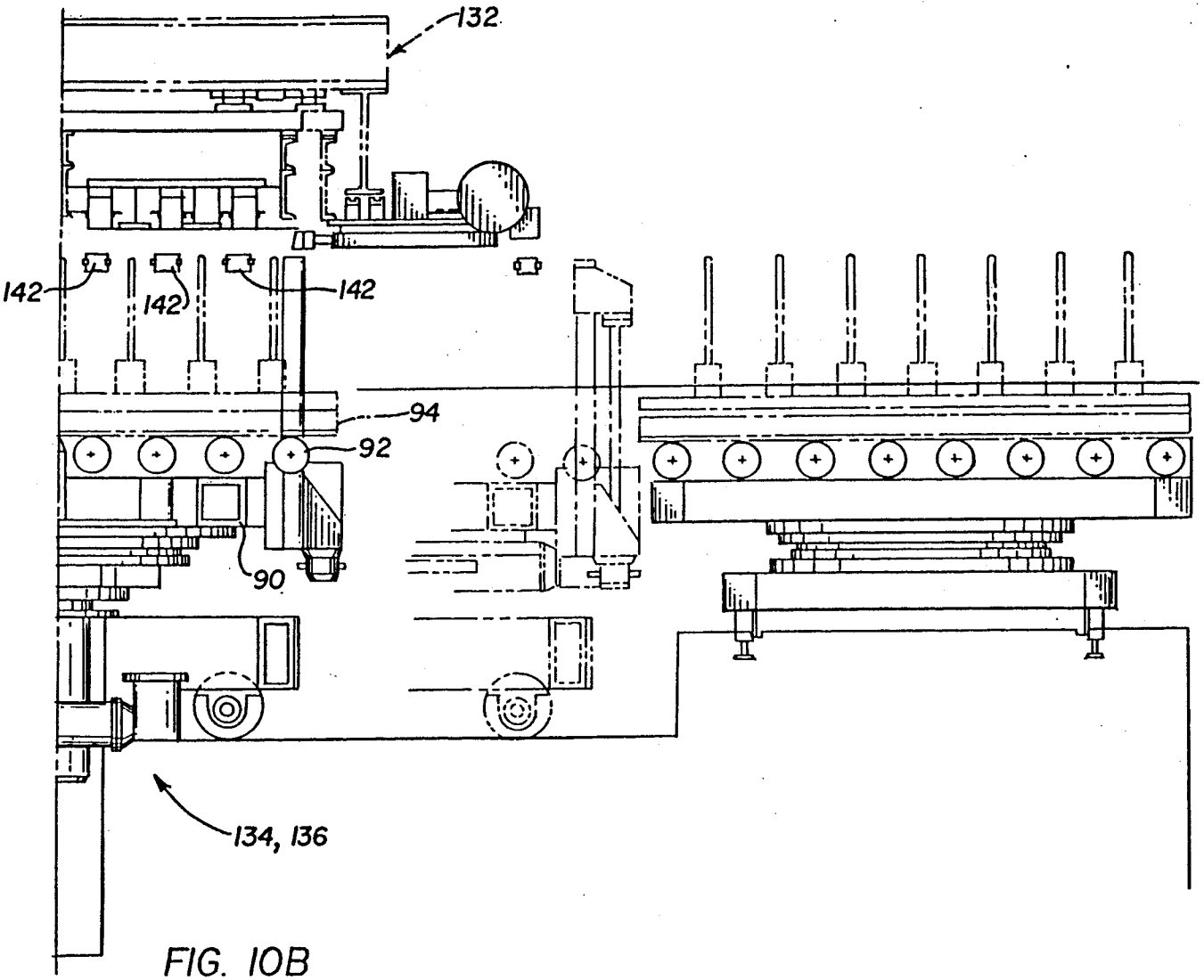

The in-line arrangement consists of two stacking stations, whereas that of FIGS. 10A and 10B consist of one stacking station. In this embodiment, the blank may have already been severed by the die and therefore has no speed of its own, but travels at the same rate as the conveyor belt assemblies 137 of magnetic pick up unit 130. As shown in phantom in FIG. 9B, assemblies 137 extend in and out of press 138, and each assembly 137 is driven through a common roller drive assembly 139 which is similar to drive roller assembly 128*a* of the second embodiment. The belt assemblies 137 of magnetic pick-up unit 130 may be similar to that of conveyor units B and F of FIGS. 8 and 8A, consisting of an array of magnets for attracting and carrying the blank along the conveyor line. When the blank exits the die in press 138, it is transported onto a conveyor located in the press from where magnetic conveyor unit 130 carries it. Lower transfer unit 140 transports the blank in the direction shown by the arrow to the overhead magnetic conveyor unit 132 which consists of several magnetic belt conveyor assemblies similar to that of unit 16 or 130 where magnets hold and transport the blank to one of the stacker cars 134, 136 in the stacking stations.

Figure 11A:
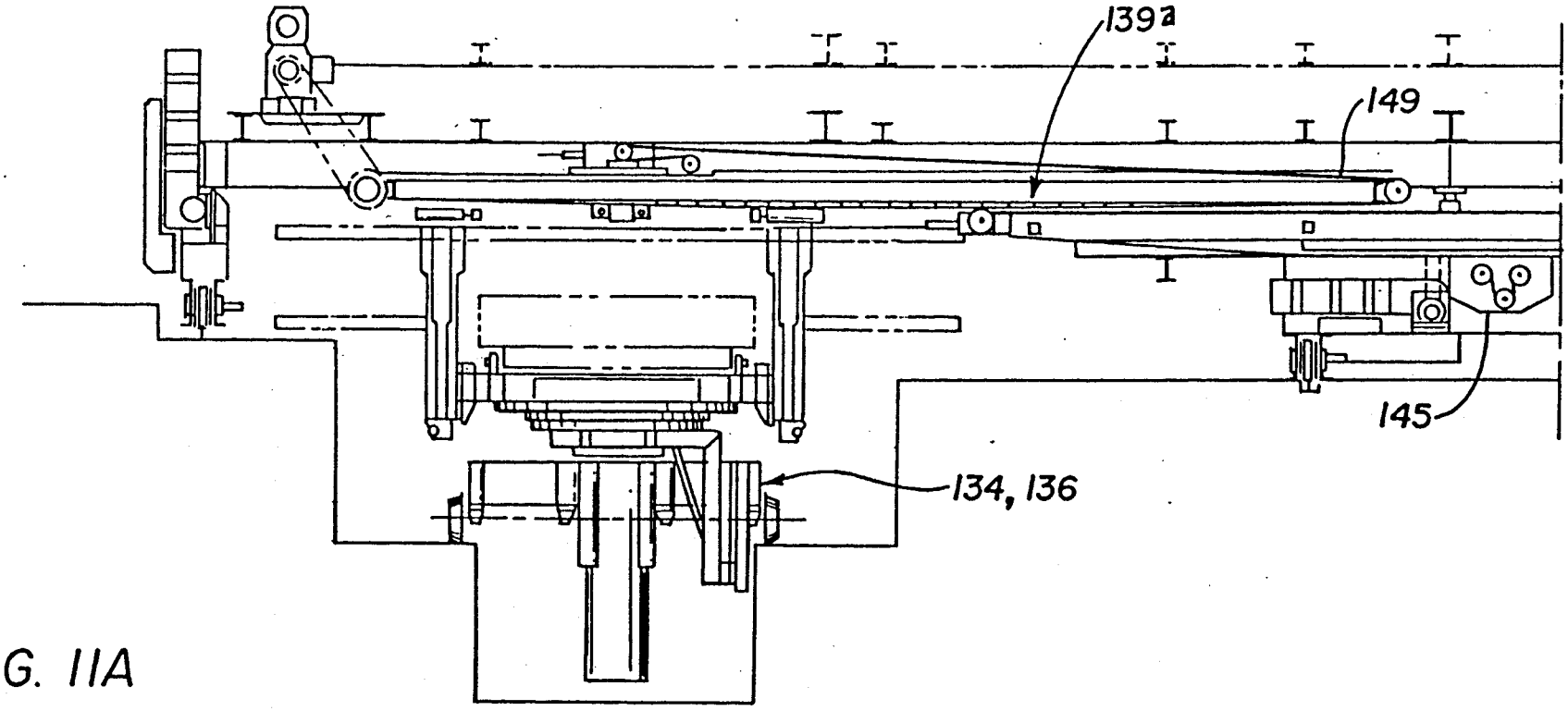
FIGS. 11A and 11B are partial views which together depict an elevational view for a side stacker arrangement located perpendicularly to the arrangement in FIGS. 9A and 9B relative to the press.
Figure 11B:
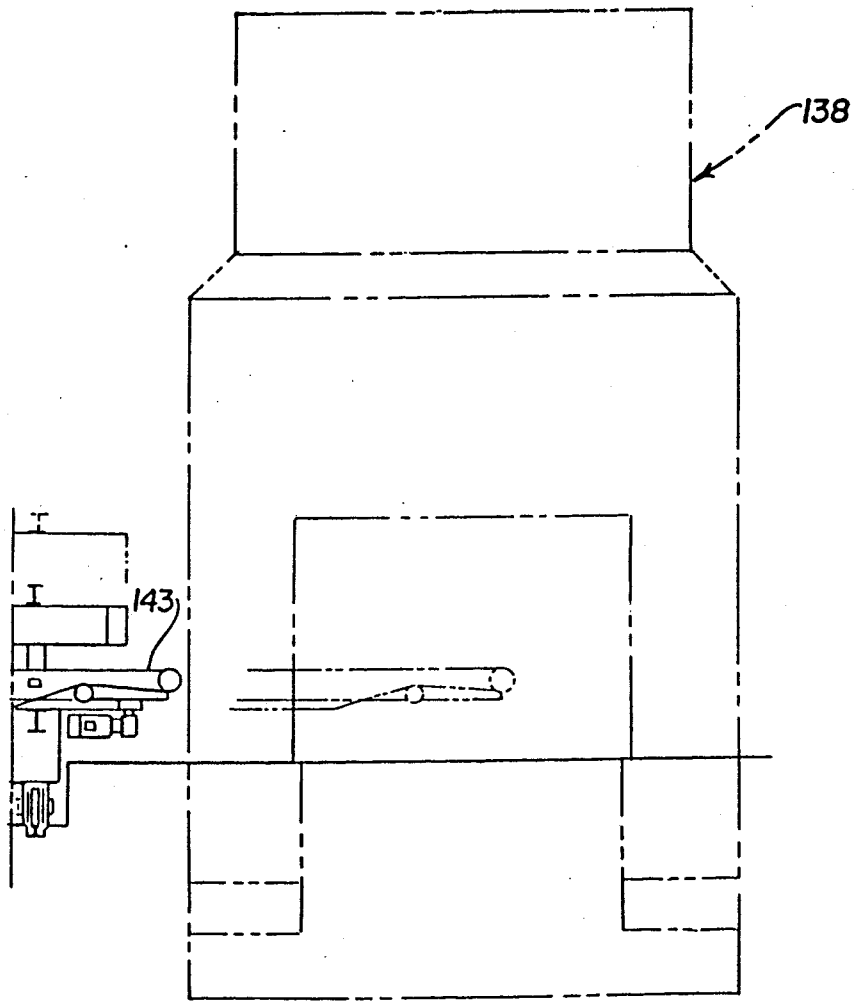
Figure 11C:
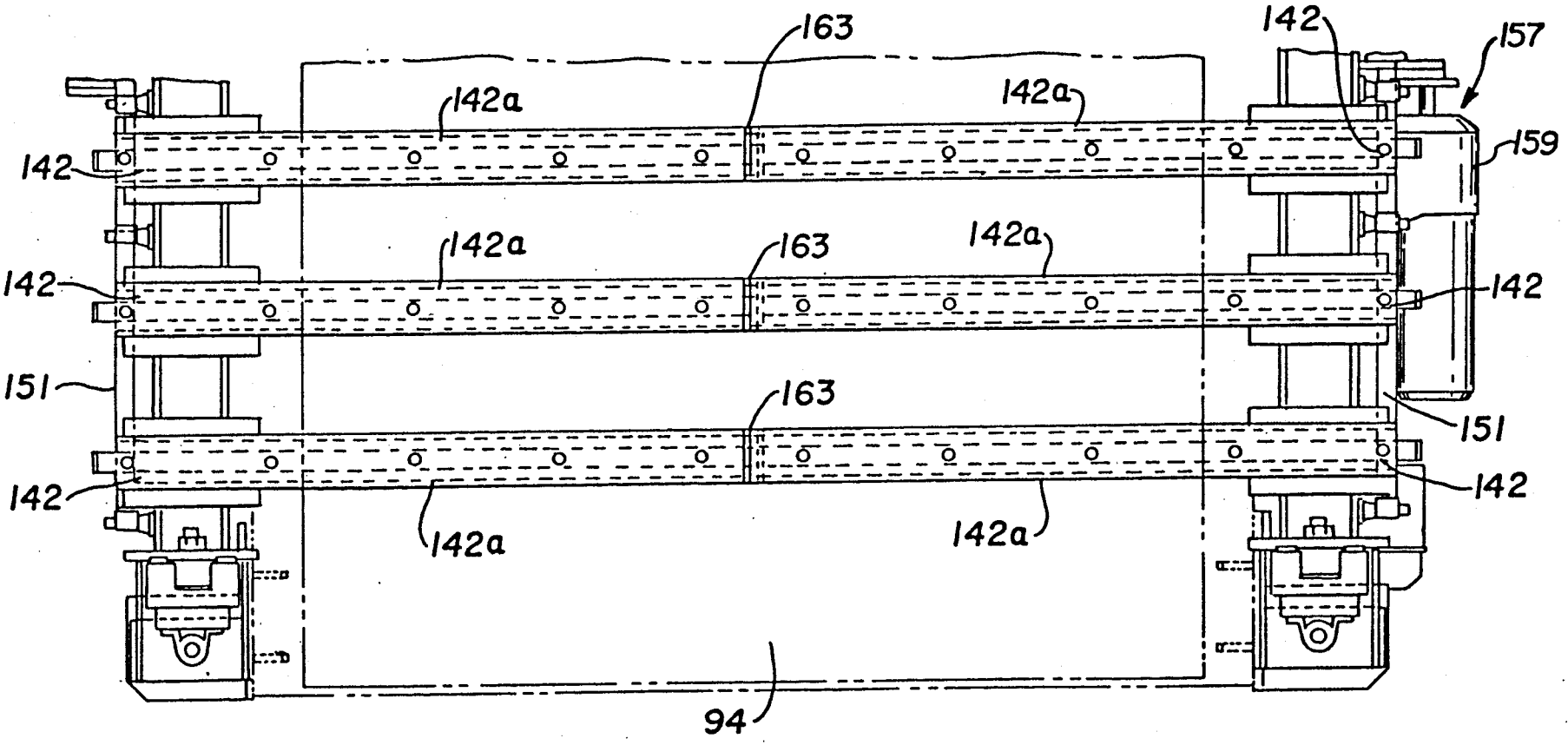
FIG. 11C is a partial plan view showing in detail the finger assemblies of the stacker car in FIGS. 10A and 10B.
Figure 11D:
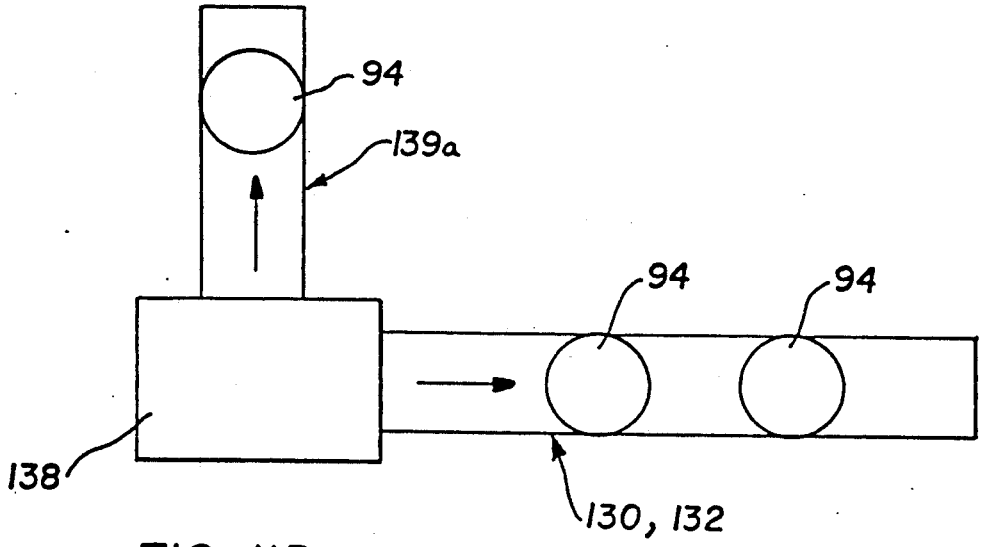
FIG. 11D is a schematic plan view showing the inline conveying system of FIGS. 9A-9B and the side stacking arrangement of FIGS. 11A-11B.

FIGS. 11A and 11B illustrate the conveying line for the side stacker arrangement as shown in FIG. 11C, and consists of overhead magnetic conveyor 139*a*, which as shown in phantom can also be raised and lowered in line with the die in the press. As FIG. 11B shows in phantom, a magnetic conveyor unit 143 through a common roller drive assembly 145 (FIG. 11A) moves the several belts into and out of the press. This common roller drive assembly 145 and the several belt conveyors are similar to that numbered 128*a* of unit B of the second embodiment, and numbered 139 of unit 130 in FIG. 9B, and operates on the same principle. From conveyor unit 143, the blank is conveyed down the line in the direction indicated by an arrow to conveyor 149 of overhead conveyor unit 139*a* which stacks the blank in the single stacking station on a single stacker car indicated as 134, 136.

Both conveyors 143 and 149 may be interconnected, comprising the magnetic overhead conveyor unit 139*a* and therefore, both may be raised and lowered as a unit relative to press 138.

Figure 11E:
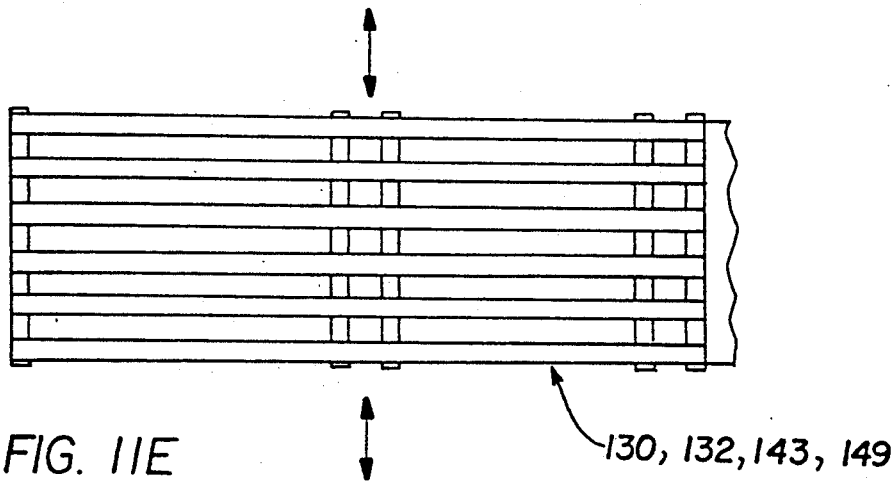
FIG. 11E is a schematic plan view of the overhead magnetic conveyor sytem of FIGS. 9A-9B.

With regard to the magnetic pick-up conveyor unit 130 and overhead conveyor unit 132 at the exit end of the press (FIGS. 9A and 9B) and the overhead magnetic unit 139*a* of the side stacker arrangement in FIGS. 11A and 11B, these units 130, 132; and 139*a* comprise multi-belt assemblies with magnets on their underside similar to the belt conveyors disclosed in the above-mentioned U.S. patents; and conveyor units 139*a* and 143 may be moved in a lateral direction as shown in FIG. 11E and indicated by the arrow in order to position the magnetic forces in the best position to accommodate the several different blanks.

The entire conveyor system of FIGS. 9A and 9B and that of 11A and 11B is raised and lowered for alignment with the top or bottom pass of the press 138. As mentioned above, the several conveyor belts of the conveyor units 139*a* and 143 can independently be moved longitudinally relative to press 138 in a manner to conform to the shape and size of the blank.

FIGS. 10A and 10B show the design for the stacker car 134, 136 in this third embodiment. A plurality of finger assemblies 142 are provided on stacker car 134, 136, and these finger assemblies 142 of stacker car 134, 136 are the basic difference between the construction of the stacker car 134, 136 and stacker car 22, 24 of the first embodiment. Otherwise, the construction and operation of cars 134, 136 is similar to cars 22, 24.

Figure 13:
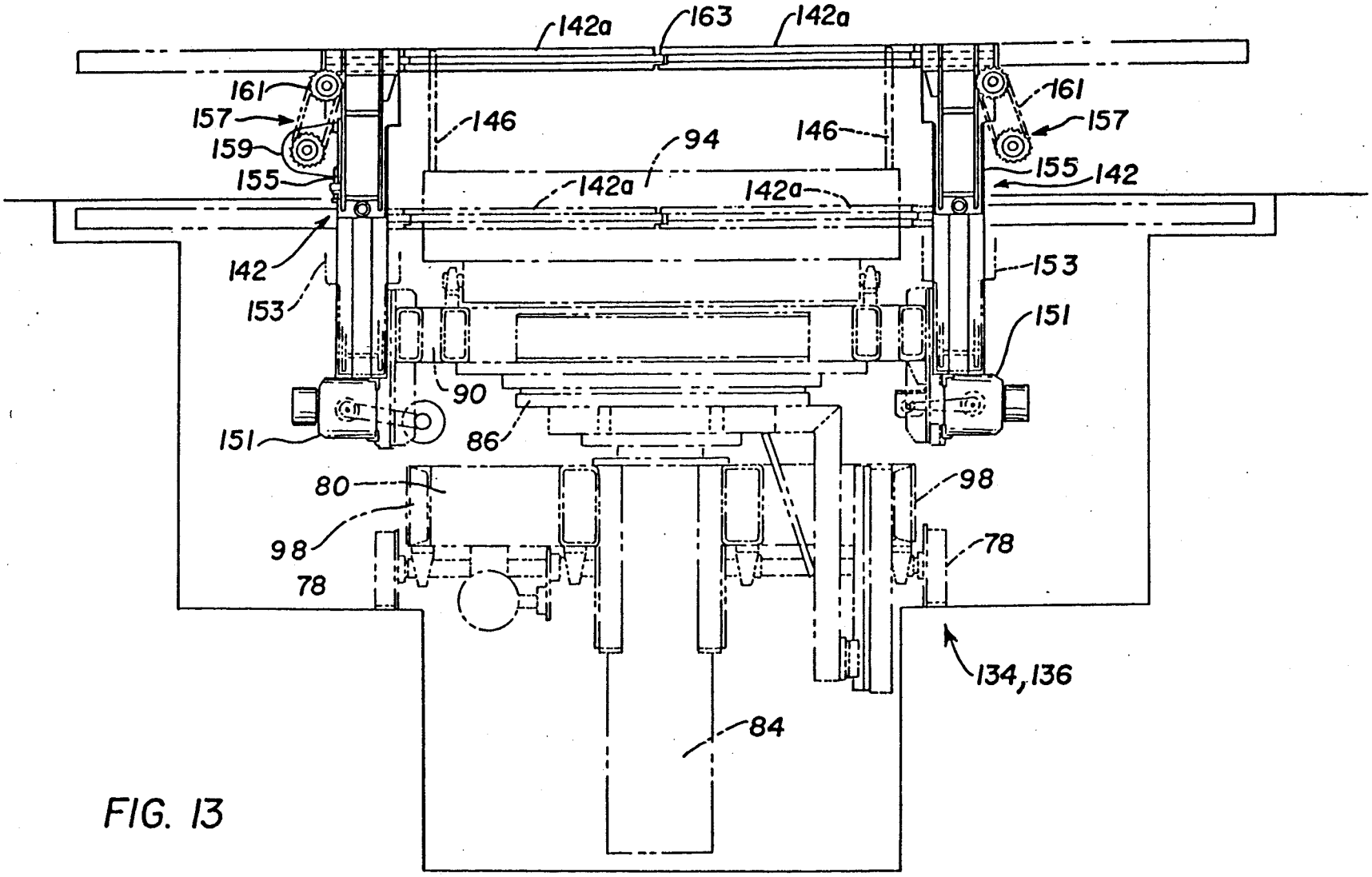
FIG. 13 is an elevational, front view of the stacker car of the second and third embodiments with a portion in cross-section.

As FIGS. 9A, 9B and 13 show, a finger assembly 142 is mounted opposite each other alongside lift elevator member 90, and as FIG. 11C shows several finger assemblies 142 cooperate with their opposing finger assembly to form a supporting surface for the blank when released by the overhead conveyor unit 132.

The finger assemblies 142 on one side of stacker car 134, 136 are driven from a common drive 151 for the raising and lowering of finger element 142*a* in a vertical direction relative to the stacking station. As FIG. 13 shows in phantom, finger element 142*a* is moved in and out in a lateral horizontal direction relative to the centerline of the pallet 94.

Each finger assembly 142 has a screw jack (not shown) in member 153 which through drive 151 raises and lowers housing member 155 in a telescopic fashion relative to member 153. Attached to housing 155 is a drive assembly 157 which is driven from a common drive 159 (FIGS. 11C and 13), which drive assembly 157 drives a rack and pinion arrangement 161. The rack of this arrangement is located on the underside of finger element 142*a*.

As can be seen in FIG. 13, opposed finger elements 142*a* each have interlocking cooperative sections indicated at 163 in the form of a notch and projection. The finger elements 142*a* are operated such that these interlocking sections for the two cooperative finger assemblies 142 are properly engageable to decrease the chance of sharp edges existing, and therefore, resisting damage to the blank.

The independent common drive 159 for the finger assemblies 142*a* on an opposing side of stacker car 134, 136 in conjunction with the rotation of stacker car 134, 136 provides the versatility for stacking two stacks of small blanks onto the two opposed sides of stacker car 134, 136. That is, the finger assemblies 142 on the opposed sides can be operated separately for stacking two stacks on one pallet 94 or together when larger blanks are stacked on the pallet 94.

When handling small blanks, the opposed finger assemblies 142 are disengaged for handling two stacks, in which case, the finger assemblies on the one side are lowered, member 90 of the car 134, 136 is rotated and the finger assemblies 142 raised for the stacking operation.

The adjusting drives 151 and 159 of finger assemblies 142 can be provided with feedback devices, such as encoders or resolvers with a micro-processor control. Also the common drives 151 for the two sides of stacker car 134, 136 can be servo-operated and controlled together for simultaneous operation of both sides.

The operation for stacking large blanks will be discussed with reference to FIGS. 9A and 9B. Initially, finger assemblies 142 are raised to a position directly beneath overhead unit 132. As each blank adds to the stack supported by the surface area created by the engagement of the opposing finger elements 142*a*, the finger assemblies 142 are simultaneously lowered to accommodate the increasing height of the stack being formed. When the undersurface of finger assemblies 142 are in close proximity to the top of pallet 94, each pair of opposed cooperative finger assemblies 142 are disengaged and are moved away from each other to gently place the stacks of blanks onto pallet 94. The finger assemblies 142 fit in an ambush fashion into the slots (not shown) in pallet 94.

In order to help retain the stack of blanks in the stacking stations, during the lowering of finger assemblies 142, several upright guide elements 146 are provided on pallet 94. Their construction is simple in nature and known in the industry and therefore further details are not necessary. The stack of blanks is lowered between guide elements 146 until the required stack height is obtained.

As FIGS. 10A and 10B show, stacker car 134, 136 is motivated on wheels similarly to that of the first embodiment and allows longitudinal movement thereof for proper centerline positioning of pallet 94 relative to the overhead unit 132. In addition, stacker car 134, 136 has the same rotational and vertical features as the stacker car of the first embodiment. To the left in FIG. 10A, a pallet is in a position to be received by the stacker car 134, 136 and to the right in FIG. 10B, a pallet is in a position for its discharge from stacker 134, 136.

Figure 12A:
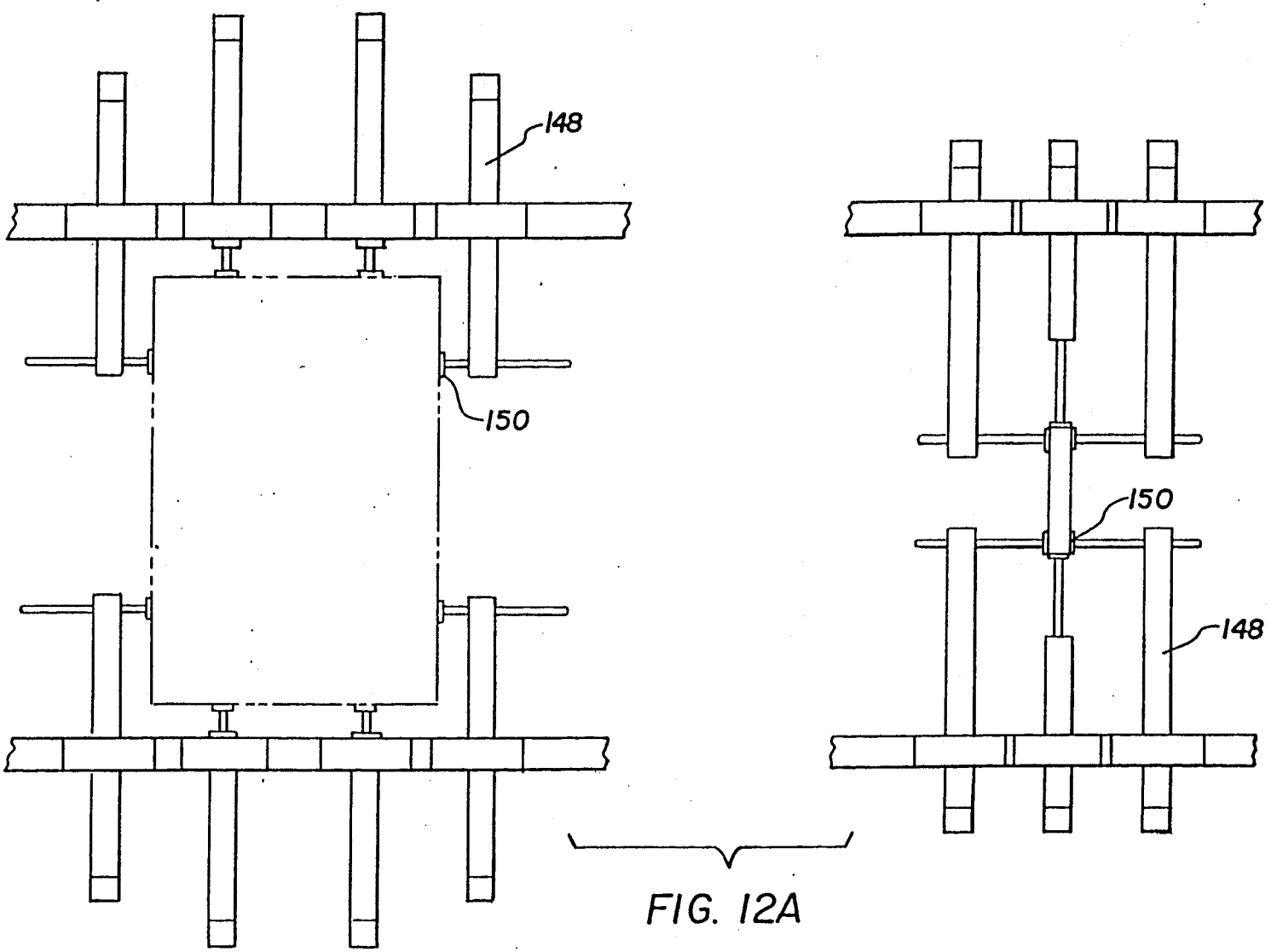
FIGS. 12A and 12B illustrate schematic segmented plan views of the robotic elements which may be utilized in both the second and third embodiments in place of the guiding-stop system shown in FIGS. 7A and 7B.
Figure 12B:
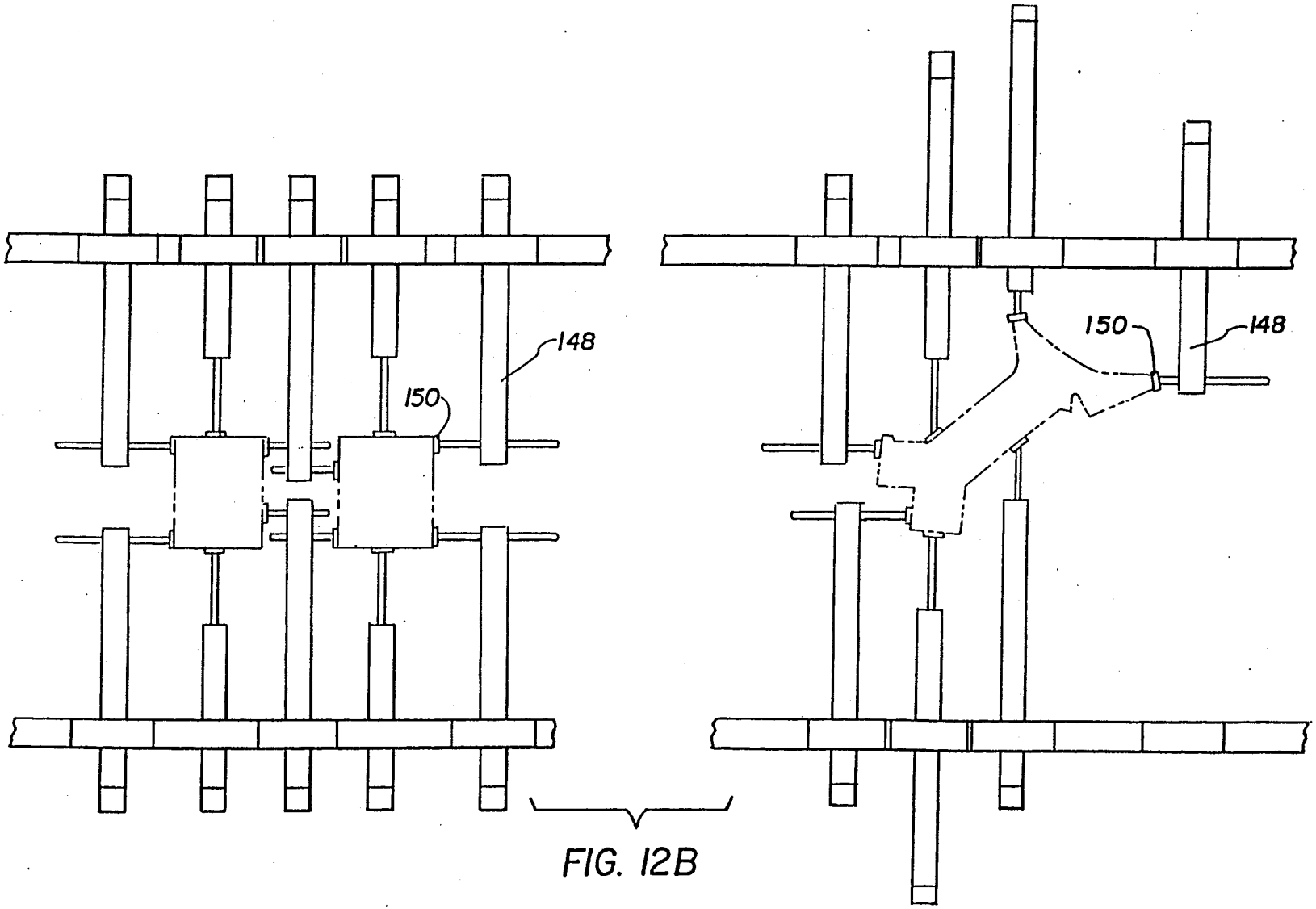

In conjunction with the overhead conveying unit 112, 114, 132 and 139*a* of both the arrangements in the second and third embodiments, the blanks can be neatly stacked by the utilization of several robotic elements 148 a few of which are numbered and shown schematically in FIGS. 12A–12B which would be mounted on a structural assembly directly beneath conveyor unit 112, 114, 132 and above stacker car 104, 106, 108, 110, 134, 136.

As shown in these FIGS. 12A–12B these robotic elements 148 are positionable by appropriate means (not shown) to assume the same configuration as the blank itself, including a pivotal face 150 to abut and conform to the outline edges, which is of particular use for polymorphic shapes, as shown to the right in FIG. 12B. These robotic elements can handle small as well as large pieces.

The robotic elements 148 are simply constructed and therefore their details are not shown. Each element 148 consists of an upright member supporting the horizontal element 148 shown in FIGS. 12A, 12B. Suitable drive means are provided in the upright support member for raising and lowering the element 148, and suitable means are provided therein for the lateral displacement in a horizontal direction as shown in FIGS. 12A and 12B. These robotic elements 148 can act as the well-known end stops, back-stops, and guides in properly handling and stacking the blanks.

This third embodiment in FIGS. 9A–13 handles stationary blanks which may have already been severed in the press, i.e. the blanks travel at the same rate of speed as the belt conveyor units. If the arrangement in this third embodiment is to be used in conjunction with blanks travelling at a rate of speed differing from the belt conveyor system, then the conveyor unit 12 of the first embodiment with the rail or carrier assemblies 28–36 can be used at the exit and side ends of the press.

The construction of the above devices and their interrelationship and cooperation relative to each other in the arrangements for the several embodiments described above allow the entire feed line press to be fully automated in such a way that an optimization for the following is achieved; 1) quick and proper handling of the blanks exiting the press; 2) neat and quick stacking of the blanks into stacks; and 3) quick handling of the pallets with or without the stacks in the press line. The control for these devices in these several arrangements can be computerized so as to automatically position the required devices to handle a blank according to its particular configuration, where this positioning is automatically recorded in the memory of a microprocessor relating to this particular blank. Position feedback transmitters, such as encoders, resolvers, pulse tachometers, etc. may be provided with the drives for the several devices for providing the necessary information. When a particular blank size and shape is to be run at another time, the blank number need only be entered and all devices will assume their proper positioning.

Even though the invention has been described in a manner herein, it is to be understood that obvious variations can be made without detracting from the scope and spirit of the present invention. For example, the arrangement in FIG. 8–8A, may consist of less stacking stations, than those shown with obvious variations to the top and lower conveyor units 112, 114. Likewise, the remaining embodiments may contain more or less stacking stations than that shown.

In accordance with the provisions of the patent statutes, we have explained the principle and operation of our invention and have illustrated and described what we consider to be the best embodiments thereof.

We claim:

1. A stacker car for supporting a stack of sheets in blank form, comprising:

an elevator member supporting a pallet, which, in turn, supports said stack of sheets, and finger assembly means mounted on said elevator member constructed and arranged to be raised to a first position and lowered to a second position and comprising at least two opposing finger elements, each said opposing finger element being extendable across a portion of said pallet in a parallel direction relative to the longitudinal length of each opposing finger element for engagement with the other to form a support surface for said stack of sheets, and said two opposing finger elements each having cooperative interlocking means for said engagement thereof across said pallet.

2. A stacker car according to claim 1, wherein said pallet consists of a plurality of elongated upright guide elements mounted on at least two of its opposed sides and cooperative with said finger elements for guiding said stack of sheets being formed on said pallet when said finger elements are in their said second position relative to said elevator member.

3. A stacker car for stacking and forming a stack of blank material, comprising:

a lift elevator member supporting a pallet, which, in turn is adapted to support said stack of blanks, means for rotating said lift elevator member, means for motivating said stacker car, and a plurality of finger assembly means mounted on opposite sides of said elevator member constructed and arranged to be raised to a first position and lowered to a second position relative to said pallet and engaging with an opposing finger assembly means to form a support surface for said stack of blanks.

4. A stacker car according to claim 3 wherein said finger assembly means consists of a finger element engageable with an opposing finger element, and wherein said pallet consists of a plurality of elongated upright elements mounted on at least two of its opposed sides and cooperative with said finger elements for guiding the stack of blanks being formed on said pallet when said finger elements are in their said second position relative to said elevator member of said stacker car.

5. A stacker car according to claim 3, further comprising means for laterally positioning said finger assembly means for said engagement of said finger assembly means with an opposing finger assembly means.

6. A stacker car according to claim 4, further comprising independent drive means for positioning said finger assembly means in said first position and said second position and associated with said finger assembly means for said lateral positioning of said finger assembly means.

7. A method of stacking blanks on a support which is located beneath a conveyor carrying the blanks which are to be stacked, the steps comprising:

providing a plurality of finger assemblies mounted on opposite sides of said support which assemblies are engageable with their opposing finger assembly, causing said engagement of said finger assemblies in order to form a support surface for receiving a blank, gradually lowering said plurality of finger assemblies as each successive blank is added to the stack increasing the height of said stack, and when said stack is formed lowering said finger assemblies below said support in order to allow removal of said stack.

8. A method according to claim 7, the steps further comprising:

providing a plurality of elongated guides for guiding said blank onto said stack, and causing said finger assemblies to travel between said guides upon their said lowering action for the stacking process.

9. A method according to claim 7, whereby at least two stacks are to be formed on said support, the steps further comprising:

causing said finger assemblies to be disengaged from its respective opposing finger assembly, raising said finger assemblies in a position to receive said blanks from said conveyor, forming a first stack of blanks on said finger assemblies of one opposed side of said support, and upon completion of said first stack of blanks, rotating said support so that said finger assemblies of said other opposed side of said support are in a position for forming a second stack of blanks.

* * * * *